US012662275B2

(12) United States Patent
Kasahara et al.

(10) Patent No.: US 12,662,275 B2
(45) Date of Patent: Jun. 23, 2026

(54) BINDING DEVICE

(71) Applicant: MAX CO., LTD., Tokyo (JP)

(72) Inventors: Akira Kasahara, Tokyo (JP); Shigeki Shindou, Tokyo (JP); Yosei Nodaguchi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 264 days.

(21) Appl. No.: 18/216,344

(22) Filed: Jun. 29, 2023

(65) Prior Publication Data

US 2024/0002088 A1 Jan. 4, 2024

(30) Foreign Application Priority Data

Jul. 1, 2022 (JP) ..... 2022-106763

(51) Int. Cl.
*B65B 27/10* (2006.01)

(52) U.S. Cl.
CPC ..... *B65B 27/10* (2013.01)

(58) Field of Classification Search
CPC ..... B65B 27/10; B65B 13/18; B65B 13/185; E04G 21/123
See application file for complete search history.

(56) References Cited

U.S. PATENT DOCUMENTS

| | | | | |
|---|---|---|---|---|
| 2005/0211111 | A1* | 9/2005 | Ropers | B65B 13/185 100/29 |
| 2022/0106067 | A1 | 4/2022 | Hamano et al. | |
| 2022/0145649 | A1 | 5/2022 | Manabe et al. | |

FOREIGN PATENT DOCUMENTS

| | | | |
|---|---|---|---|
| CN | 107165418 | A | 9/2017 |
| EP | 3978705 | A1 | 4/2022 |
| JP | H08-034406 | A | 2/1996 |
| JP | 2013-035052 | A | 2/2013 |
| JP | 2019-039170 | A | 3/2019 |
| JP | 2022-60996 | A | 4/2022 |

OTHER PUBLICATIONS

Dec. 1, 2023—(EP) Exended Search Report—EP App 23182718.9.

* cited by examiner

*Primary Examiner* — Teresa M Ekiert

(74) *Attorney, Agent, or Firm* — Banner & Witcoff, Ltd.

(57) ABSTRACT

A binding device includes a main body part and a traveling part configured to travel the main body part. The main body part includes a binding mechanism configured to feed a plurality of wires around a reinforcing bar, and to twist and bind the plurality of wires fed around the reinforcing bar, a binding mechanism moving part configured to move the binding mechanism between a binding position where binding of the reinforcing bar is performed and a retreat position away from the reinforcing bar, a reel accommodation part configured to accommodate a plurality of reels on each of which one wire is wound, and a path induction part configured to form a feeding path of wires pulled out from the plurality of reels accommodated in the reel accommodation part between the binding mechanism and the reel accommodation part.

14 Claims, 20 Drawing Sheets

BINDING DEVICE

CROSS-REFERENCE TO RELATED APPLICATIONS

This application is based upon and claims the benefit of priority from prior Japanese patent application No. 2022-106763, filed on Jul. 1, 2022, the entire contents of which are incorporated herein by reference.

TECHNICAL FIELD

The present invention relates to a binding device for binding a reinforcing bar with a wire.

BACKGROUND ART

For concrete buildings, reinforcing bars are used so as to improve strength. The reinforcing bars are bound with wires so that the reinforcing bars do not deviate from predetermined positions during concrete placement.

In the related art, suggested is a binding machine called a reinforcing bar binding machine that binds two or more reinforcing bars with a wire by winding the wire around two or more reinforcing bars and twisting the wire wound on the reinforcing bars. The reinforcing bar binding machine has such a form that an operator grips and uses with a hand, and is configured such that a reel on which the wire is wound is accommodated in the reinforcing bar binding machine.

In contrast, a reinforcing bar grid manufacturing apparatus to which a reinforcing bar binding machine that an operator grips and uses with a hand is applied is suggested (for example, refer to JP2013-35052A). For a binding device having such a reinforcing bar binding machine, a configuration in which a reel on which a wire is wound is accommodated outside the reinforcing bar binding machine is suggested.

SUMMARY

In the binding device having the reinforcing bar binding machine, since the reel on which the wire is wound can be accommodated outside the reinforcing bar binding machine, a diameter of the reel (height of a flange portion) or a width of the reel (length of a winding core portion) can be enlarged without being affected by a size of the reinforcing bar binding machine, and therefore, an amount of winding of the wire can be increased to increase an amount of the wire to be accommodated.

However, in a configuration where a plurality of wires are wound on one reel when using a reinforcing bar binding machine that binds reinforcing bars with a plurality of wires, winding up the plurality of wires with one reel so that there occurs no abnormal wire deformation or large curl difference between the plurality of wires at the time of pulling out the wires from the reel becomes more difficult as the reel size increases and the amount of winding increases, leading to higher management costs and poorer yields.

In addition, since the occurrence of abnormal wire deformation or large curl difference between the plurality of wires cannot be sufficiently suppressed, it becomes difficult to manage a wire feeding path from the reel outside the reinforcing bar binding machine to the reinforcing bar binding machine. Further, a curl locus of the wire when winding the wire around the reinforcing bar with the reinforcing bar binding machine is affected.

The present disclosure has been made in view of the above situations, and an object thereof is to provide a binding device suitable for use of a binding mechanism for binding reinforcing bars with a plurality of wires.

According to an aspect of the present disclosure, a binding device includes a main body part and a traveling part configured to travel the main body part. The main body part includes a binding mechanism configured to feed a plurality of wires around a reinforcing bar, and to twist and bind the plurality of wires fed around the reinforcing bar, a binding mechanism moving part configured to move the binding mechanism between a binding position where binding of the reinforcing bar is performed and a retreat position away from the reinforcing bar, a reel accommodation part configured to accommodate a plurality of reels on each of which one wire is wound, and a path induction part configured to form a feeding path of wires pulled out from the plurality of reels accommodated in the reel accommodation part between the binding mechanism and the reel accommodation part.

In the present disclosure, the plurality of wires pulled out from the plurality of reels on each of which one wire is wound are fed to the binding mechanism, and the binding machine binds the reinforcing bars with the plurality of wires.

According to the present disclosure, one wire is wound on each reel, so a factor of entanglement of a plurality of wires within the reel is eliminated. In this way, by adopting the configuration in which one wire is wound on one reel, there is no need to consider occurrence of a large curl difference between a plurality of wires, the management cost of manufacturing a reel on which a wire is wound can be reduced, and the yield can be improved.

In addition, since abnormal wire deformation, which may be caused when two wires are wound on one reel, can be eliminated, management of a wire feeding path from the reel outside the binding mechanism to the binding mechanism is facilitated. Further, factors affecting a curl locus of the wire when winding the wire around the reinforcing bar with the binding mechanism can be eliminated. Further, in the configuration in which the main body part is traveled by the traveling part, entanglement of the plurality of wires within the reel due to vibration during traveling or the like is suppressed. Therefore, it is possible to suppress occurrence of poor wire pull-out or poor feeding.

DESCRIPTION OF EMBODIMENTS

Hereinafter, embodiments of the binding device for binding reinforcing bars with wires will be described with reference to the drawings.

Configuration Example of Binding Device of Present Embodiment

Figure 1A:
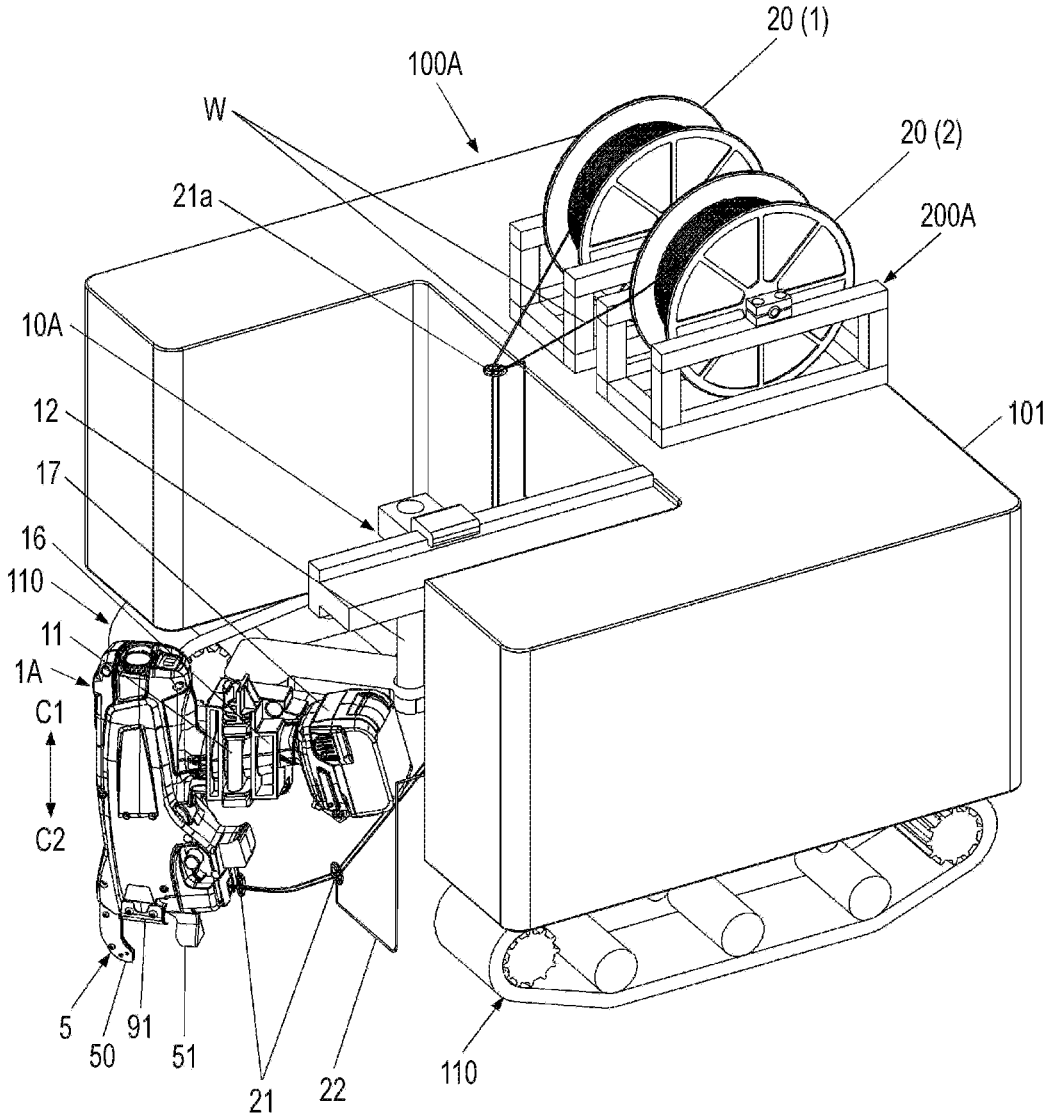
FIG. 1A is a perspective view showing an example of a binding device according to a first embodiment.
Figure 1B:
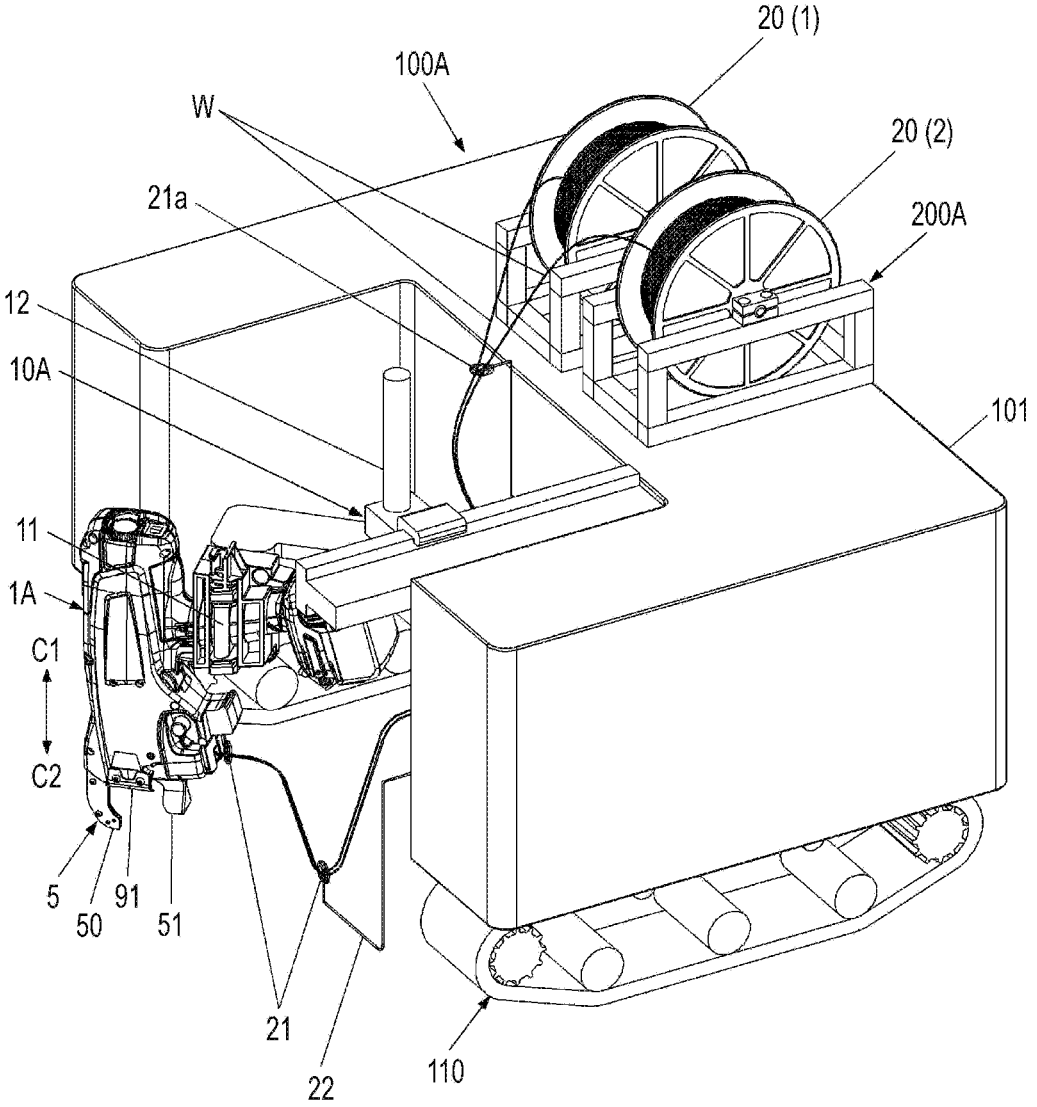
FIG. 1B is a perspective view showing the example of the binding device according to the first embodiment.
Figure 1C:
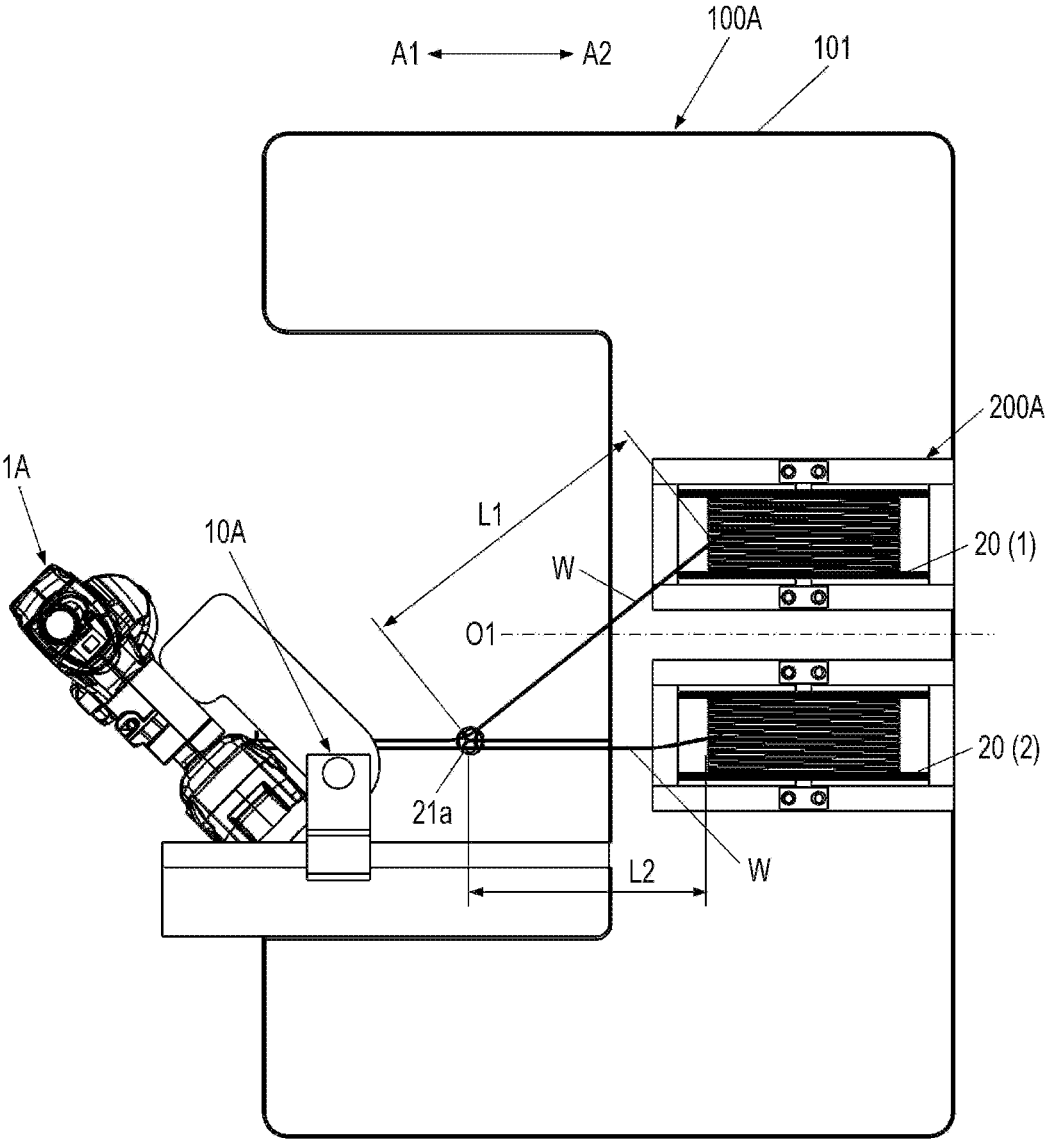
FIG. 1C is a top view showing the example of the binding device according to the first embodiment.
Figure 1D:
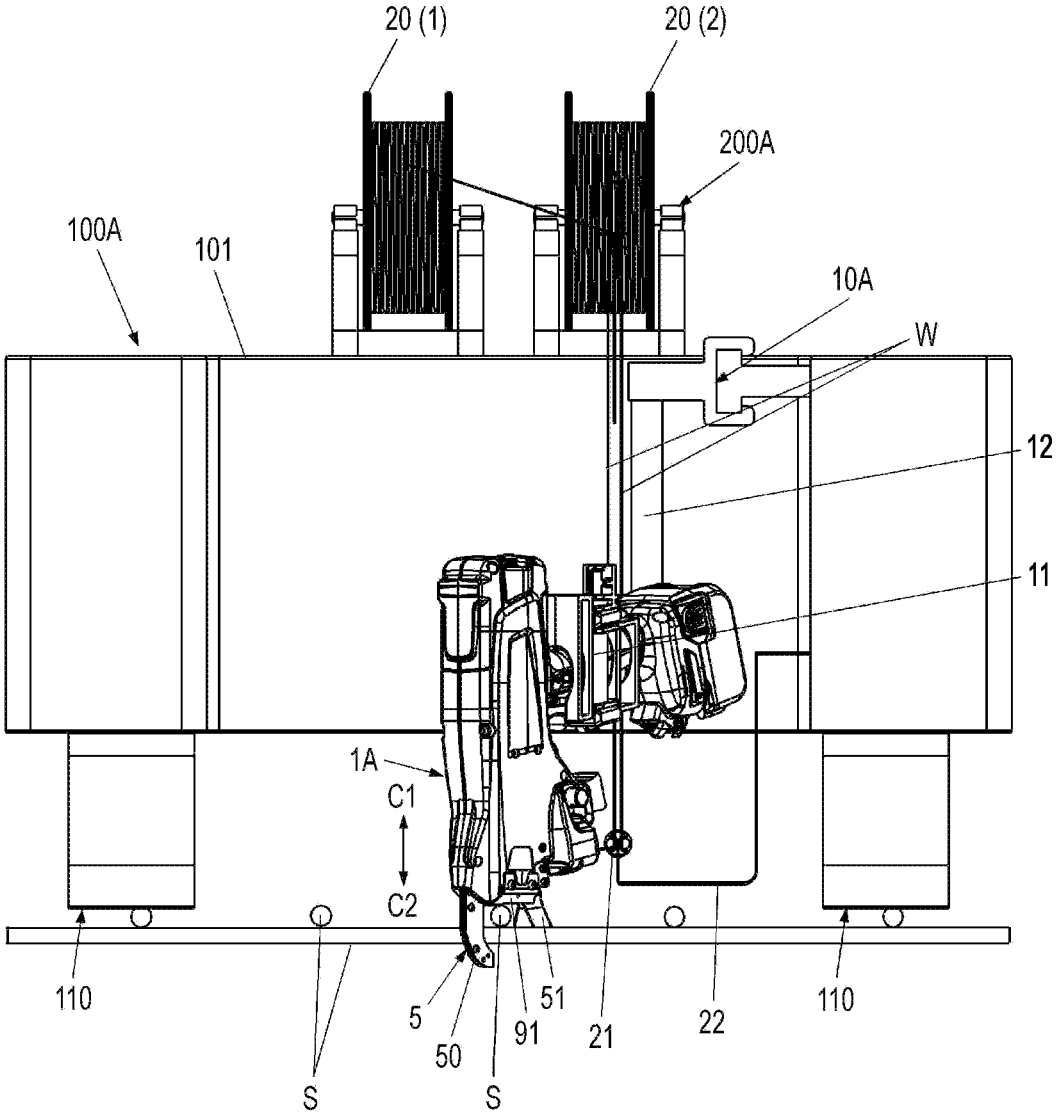
FIG. 1D is a front view showing the example of the binding device according to the first embodiment.

FIGS. 1A and 1B are perspective views showing an example of a binding device according to a first embodiment, FIG. 1C is a top view showing the example of the binding device according to the first embodiment, and FIG. 1D is a front view showing the example of the binding device according to the first embodiment.

A binding device 100A of the first embodiment includes a main body part 101 and a traveling part 110 that moves the main body part 101. The binding device 100A includes, on the main body part 101, a reinforcing bar binding machine 1A that binds intersections of reinforcing bars S arranged in a grid shape with wires W, and a binding machine moving part that moves the reinforcing bar binding machine 1A between a binding position and a retreat position in a substantially vertical direction intersecting an arrangement surface of the reinforcing bars S.

In addition, the binding device 100A includes, on the main body part 101, a reel accommodation part 200A in which a reel 20 on which the wire W that is used in the reinforcing bar binding machine 1A is wound is accommodated.

The binding device 100A has a configuration in which the traveling part 110 rides on the reinforcing bars S arranged in a grid shape and the main body part 101 moves, and the arrangement surface of the reinforcing bars S becomes a substantially horizontal surface.

An outline of operations of the binding device 100A will be described. The binding device 100A moves with the traveling part 110 so that a position of the reinforcing bar binding machine 1A matches an intersection of the reinforcing bars S, which are an object to be bound, the binding machine moving part 10A moves the reinforcing bar binding machine 1A from a standby position shown in FIG. 1B to a binding position shown in FIG. 1A, and then the reinforcing bar binding machine 1A binds the reinforcing bars S with the wires W.

When the binding of the reinforcing bars S by the reinforcing bar binding machine 1A is completed, the binding machine moving part 10A moves the reinforcing bar binding machine 1A from the binding position to the standby position. Then, the binding device 100A moves with the traveling part 110 so that the position of the reinforcing bar binding machine 1A matches an intersection of the reinforcing bars S, which are a next object to be bound.

Next, the configuration of each part of the binding device 100A will be described. The binding machine moving part 10A is an example of the binding mechanism moving part, and includes a binding machine mounting part 11 to which the reinforcing bar binding machine 1A is mounted, and a drive part 12 that moves the binding machine mounting part 11 in a vertical direction indicated by arrows C1 and C2. The drive part 12 includes a power source such as a motor and an actuator capable of controlling an amount of movement, a moving direction, a moving speed, and the like, and various mechanisms for converting movement (output) of the power source into movement in the directions of arrows C1 and C2 of the binding machine mounting part 11.

The binding machine moving part 10A moves the reinforcing bar binding machine 1A mounted to the binding machine mounting part 11 in an upward direction indicated by the arrow C1 by a predetermined amount, thereby moving the reinforcing bar binding machine 1A to the retreat position. In addition, the binding machine moving part 10A moves the reinforcing bar binding machine 1A mounted to the binding machine mounting part 11 in a downward direction indicated by the arrow C2 by a predetermined amount, thereby moving the reinforcing bar binding machine 1A from the retreat position to the binding position.

As shown in FIG. 1C, the binding device 100A is provided with, at one side of the rectangular main body part 101, a concave part having a shape into which parts or all of the reinforcing bar binding machine 1A and the binding machine moving part 10A are introduced. In addition, the binding device 100A has the traveling part 110 provided on a lower surface of the main body part 101.

The traveling part 110 includes an endless track that is driven by a motor (not shown). In the binding device 100A, the endless track constituting the traveling part 110 rides on the reinforcing bars S arranged in a grid shape, and the endless track rotates to move along the arrangement surface of the reinforcing bars S. The traveling part 110 is provided on each of both sides in a left-right direction intersecting the moving direction of the main body part 101.

Further, the binding device 100A has the reel accommodation part 200A provided on an upper surface of the main body part 101. The reel accommodation part 200A accommodates two reels 20 on each of which one wire W is wound to be pulled out for one reinforcing bar binding machine 1A that winds and binds the two wires W around the reinforcing bar S.

In the reel accommodation part 200A, the two reels 20 are accommodated in such an arrangement that the reels are aligned in the left-right direction intersecting the moving direction (going straight) (indicated by arrows A1 and A2) of the main body part 101 that is moved by the traveling part 110. In the present example, in the reel accommodation part 200A, the two reels 20 are provided at left and right positions symmetrical to each other with respect to an imaginary line extending in the moving direction of the main body part 101 that is moved by the traveling part 110. Specifically, the two reels 20 are provided at positions symmetrical with respect to an imaginary center line O1 that passes through a center in the left-right direction orthogonal to the moving direction of the main body part 101 and extends along the moving direction of the main body part 101. Additionally, in the reel accommodation part 200A, the two reels 20 are each provided on an inner side of each of the pair of traveling parts 110 provided on both sides in the left-right direction intersecting the moving direction of the main body part 101. Further, in the reel accommodation part 200A, the two reels 20 are rotatably accommodated in such an arrangement that the reels are aligned coaxially along the axial directions, with axes of rotation being transverse orientations to the vertical direction.

Figure 2:
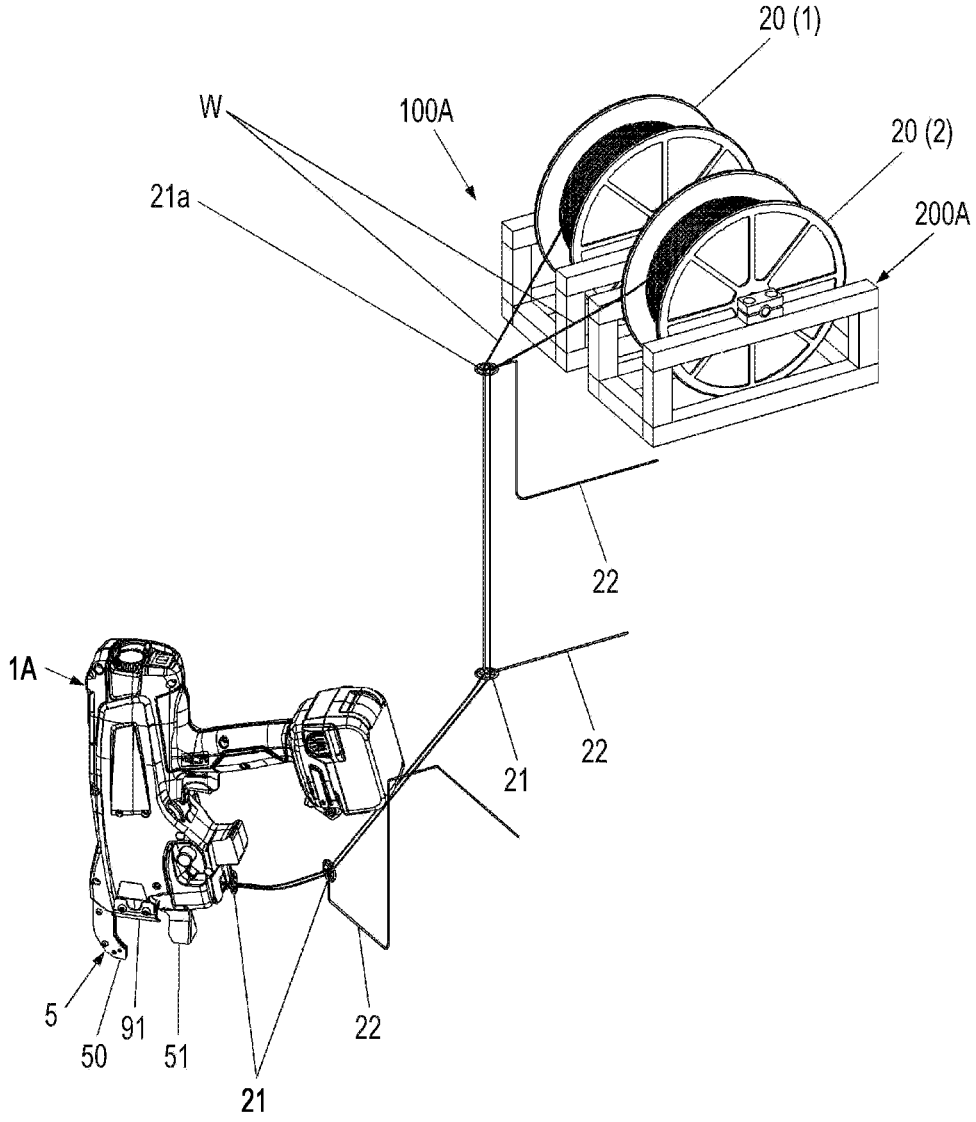
FIG. 2 is a perspective view showing an example of a wire feeding path.
Figure 3A:
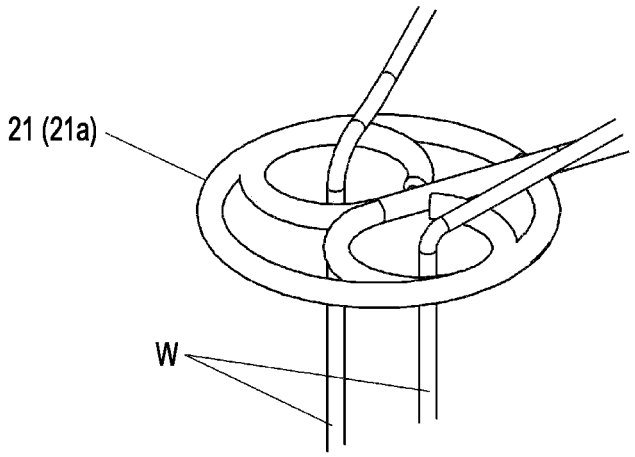
FIG. 3A is a perspective view showing an example of a path induction member.
Figure 3B:
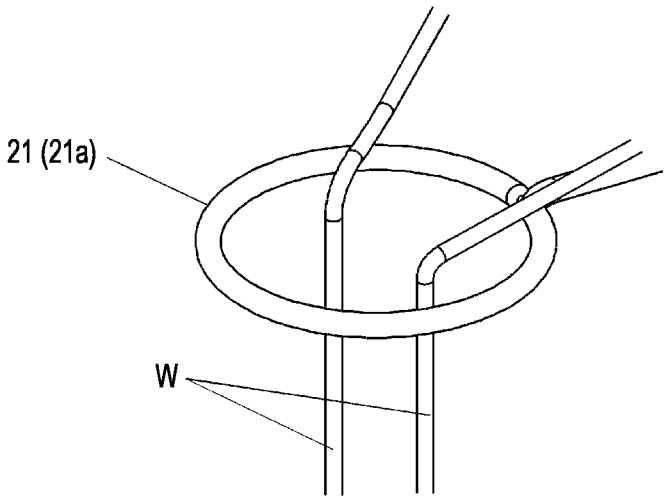
FIG. 3B is a perspective view showing an example of a path induction member.

FIG. 2 is a perspective view showing an example of a wire feeding path, and FIGS. 3A and 3B are perspective views showing an example of a path induction member.

The binding device 100A includes path induction members 21 that are provided at a plurality of locations between the reinforcing bar binding machine 1A and the reel accommodation part 200A to form a feeding path of the wire W.

The path induction members 21 are an example of the path induction part, are attached to the main body part 101 by support members 22, and are provided at a plurality of locations along a feeding path of the wire W. In the binding device 100A, the wire W is caused to pass through the annular path induction members 21, so that a feeding path of the wire W from the reel accommodation part 200A to the reinforcing bar binding machine 1A is formed.

As shown in FIG. 3A, the path induction member 21 is configured by a combination of two annular members that form independent feeding paths of the two wires W, and one wire W is caused to pass through each annular member. Further, as shown in FIG. 3B, the path induction member 21 may be configured by one annular member that forms a non-independent feeding path of the two wires W, and the two wires W may be caused to pass through the one annular member.

One path induction member 21*a* of the plurality of path induction members 21 collects the wires W each pulled out from each of the two reels 20. In addition, the path induction member 21 between the path induction member 21*a* for collecting the wires W pulled out from the two reels 20 and the reinforcing bar binding machine 1A guides the two collected wires W to the reinforcing bar binding machine 1A in a parallel form. In the present example, the path induction member 21 closest to the reel accommodation part 200A constitutes the path induction member 21*a* for collecting the wires W each pulled out from each of the two reels 20.

In the reel 20, the wire W is wound by overlapping in a radial direction while changing its position along an axial direction of a winding core portion (not shown) of the reel 20. For this reason, in an operation of pulling out the wire W from the reel 20, a position where the wire W is pulled out changes along the axial direction of the reel 20. In addition, the position where the wire W is pulled out changes along the radial direction of the reel 20, according to an amount of wire W used. Thereby, in the operation of pulling out the wire W from the reel 20, an introduction direction of the wire W to the path induction member 21*a* is changed. However, since a portion of the path induction member 21*a* that the wire W contacts is a curved surface, an increase in resistance due to frictional movement is suppressed.

In addition, since portions of the other path induction members 21 that the wire W contacts are also curved surfaces, an increase in resistance due to frictional movement is suppressed. Further, for the path induction member 21 at a site close to the reinforcing bar binding machine 1A, an introduction direction of the wire W to the path induction member 21 is changed in an operation in which the reinforcing bar binding machine 1A moves between the binding position and the standby position. However, since the portion of the path induction member 21 where the wire W contacts is a curved surface, an increase in resistance due to frictional movement is suppressed, and therefore, the wire W is suppressed to hinder the operation in which the reinforcing bar binding machine 1A moves between the binding position and the standby position.

Figure 4A:
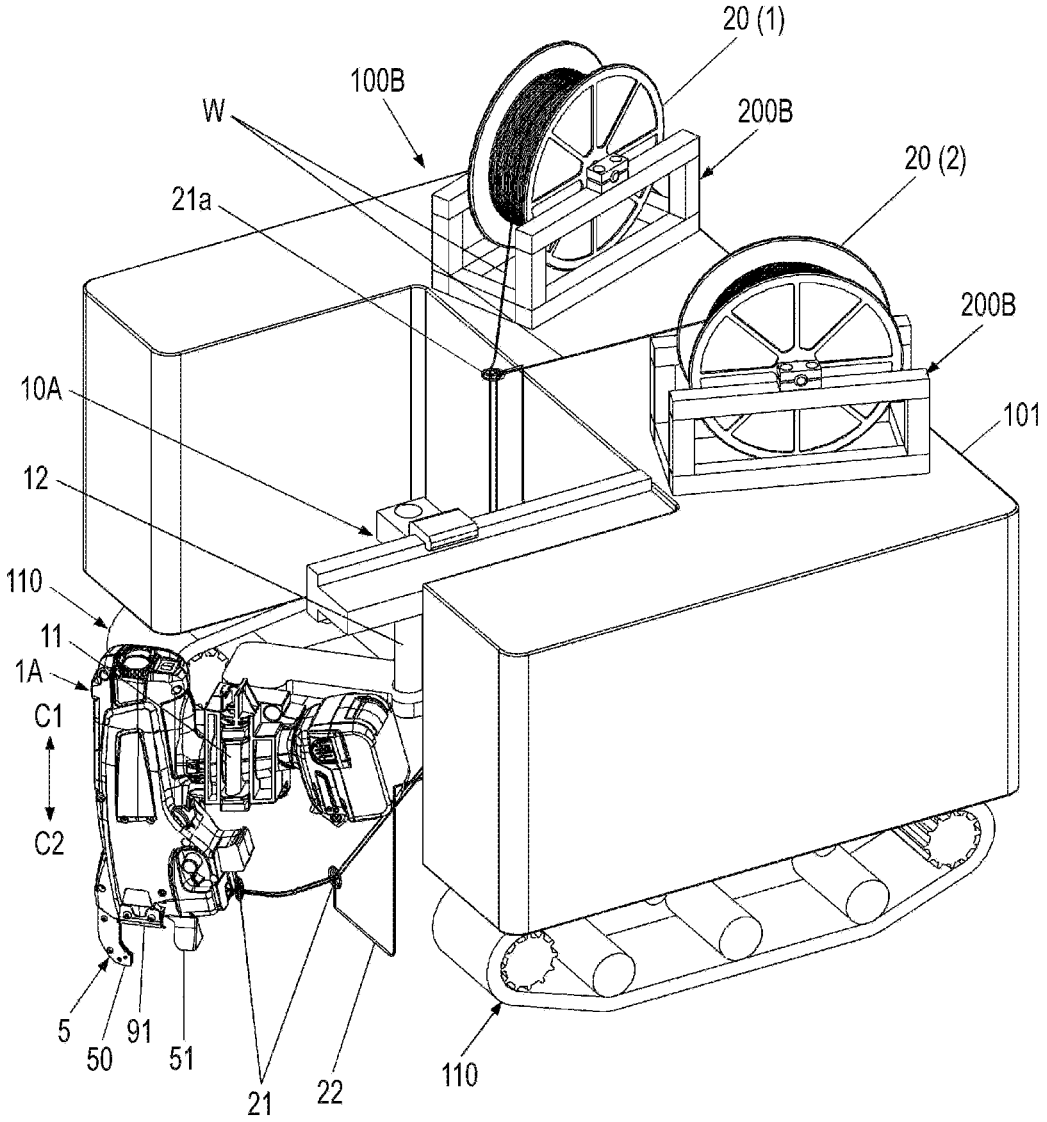
FIG. 4A is a perspective view showing an example of a binding device according to a second embodiment.
Figure 4B:
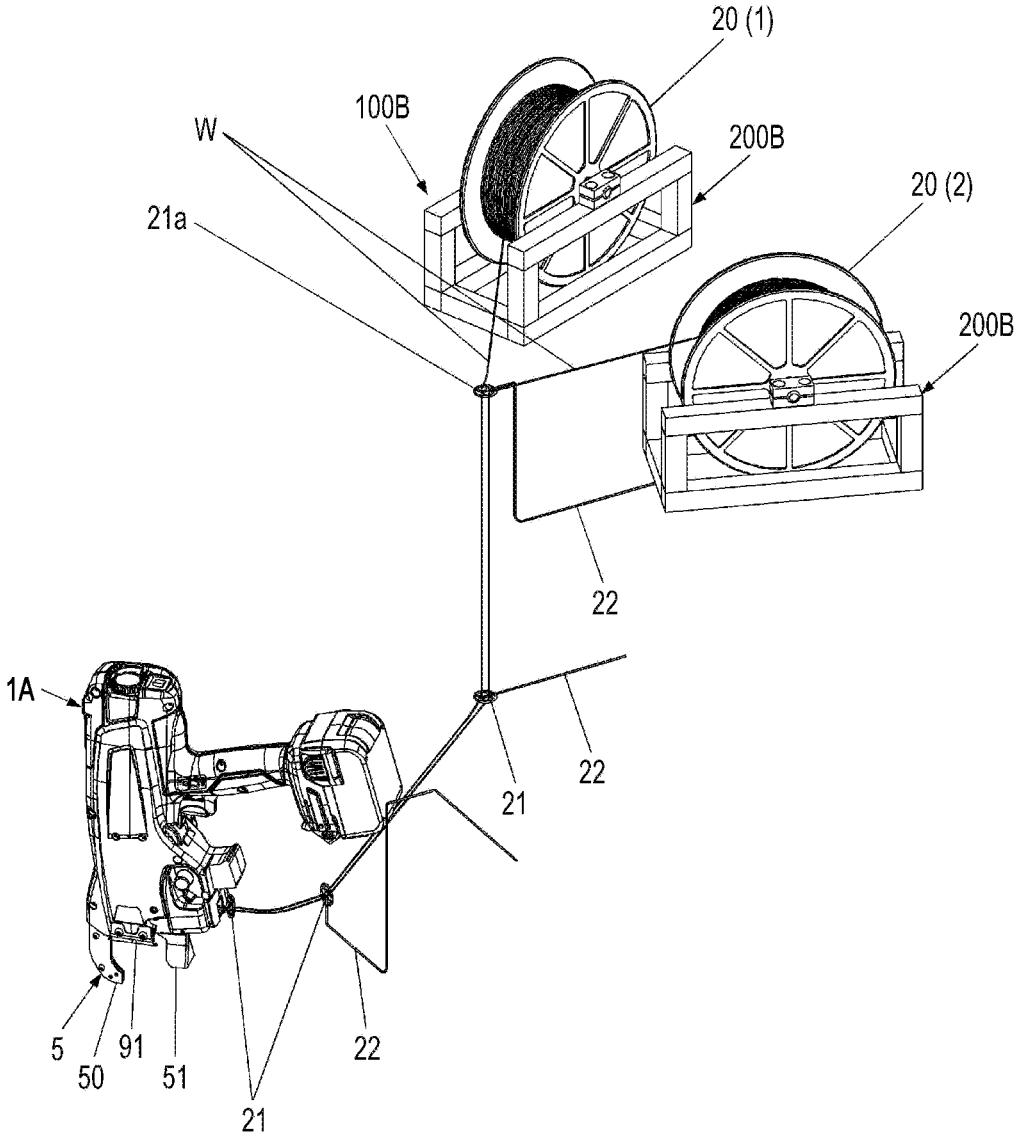
FIG. 4B is a perspective view showing an example of a wire feeding path.

FIG. 4A is a perspective view showing an example of a binding device according to a second embodiment, and FIG. 4B is a side view showing an example of a wire feeding path.

A binding device 100B of the second embodiment includes a reel accommodation part 200B that accommodates a plurality of reels 20, two reels 20 in the present example. The binding device 100B of the second embodiment has the same configuration as that of the binding device 100A of the first embodiment, except the reel accommodation part 200B.

In the reel accommodation part 200B, the two reels 20 are accommodated in such an arrangement that the reels are aligned in the left-right direction intersecting the moving direction of the main body part 101 that is moved by the traveling part 110. In the present example, in the reel accommodation part 200B, the two reels 20 are provided on end portion sides of the main body part 101 at left and right positions symmetrical to each other with respect to an imaginary line (not shown) extending in the moving direction of the main body part 101 that is moved by the traveling part 110. Further, in the reel accommodation part 200B, the two reels 20 are accommodated to be rotatable in such an orientation that the axial directions intersect each other, with axes of rotation being transverse orientations to the vertical direction.

Figure 5A:
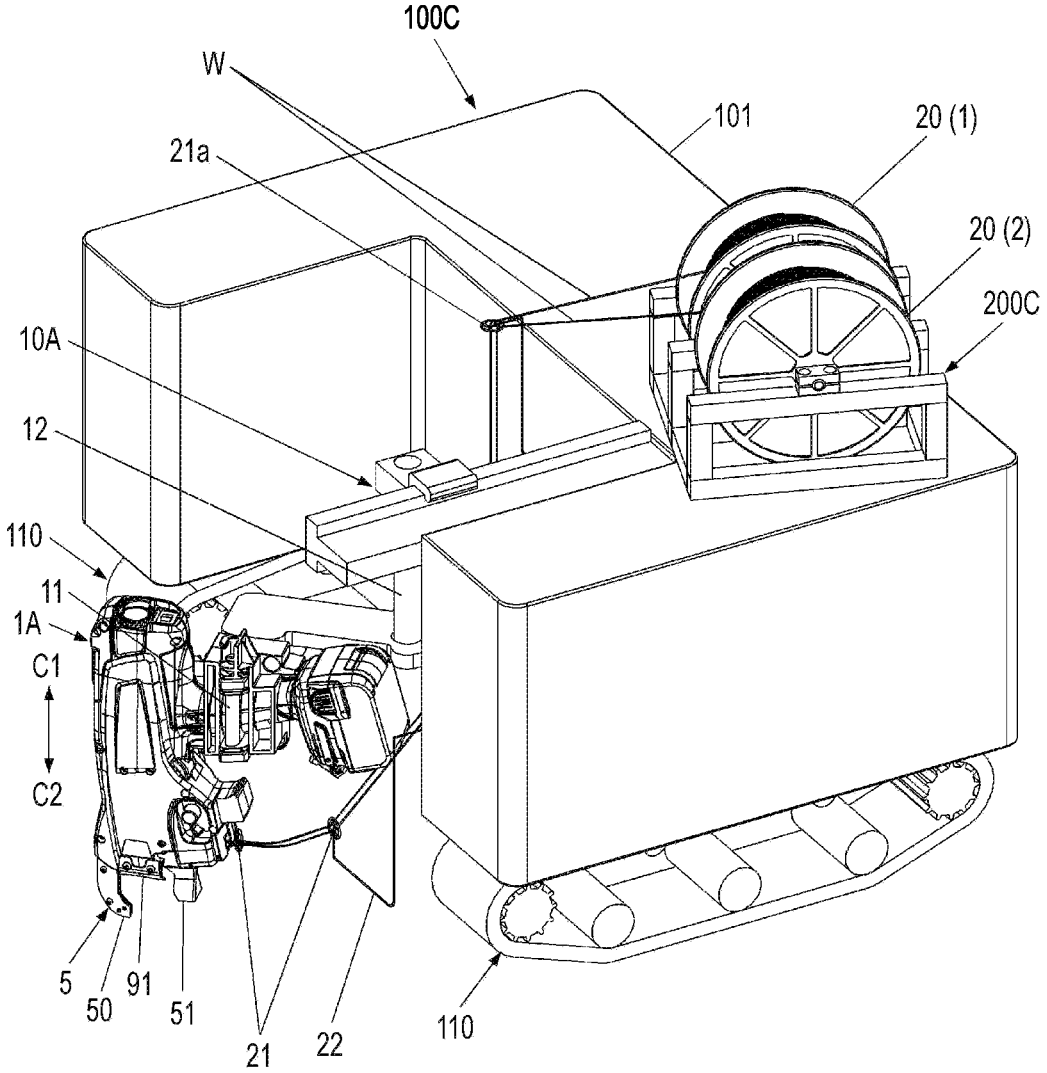
FIG. 5A is a perspective view showing an example of a binding device according to a third embodiment.
Figure 5B:
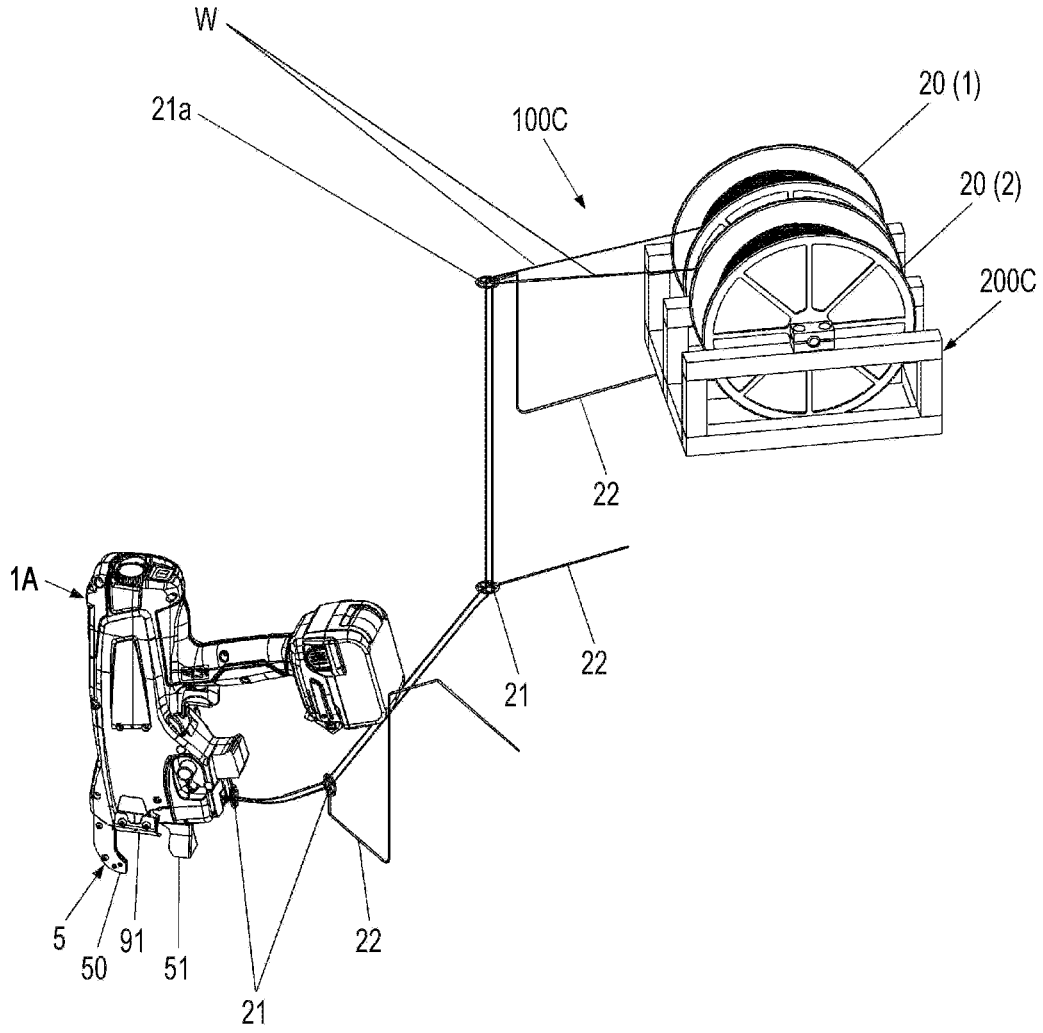
FIG. 5B is a perspective view showing an example of a wire feeding path.

FIG. 5A is a perspective view showing an example of a binding device according to a third embodiment, and FIG. 5B is a perspective view showing an example of a wire feeding path.

A binding device 100C of the third embodiment includes a reel accommodation part 200C that accommodates a plurality of reels 20, two reels 20 in the present example. The binding device 100C of the third embodiment has the same configuration as that of the binding device 100A of the first embodiment, except the reel accommodation part 200C.

In the reel accommodation part 200C, the two reels 20 accommodated in such an arrangement that the reels are aligned in the left-right direction intersecting the moving direction of the main body part 101 that is moved by the traveling part 110. In the present example, in the reel accommodation part 200C, the two reels 20 are provided on one side of the main body part 101 in the left-right direction. In addition, in the reel accommodation part 200C, the two reels 20 are rotatably accommodated in such an arrangement that the reels are aligned coaxially along the axial directions, with axes of rotation being transverse orientations to the vertical direction and inclined orientations with respect to the moving direction of the main body part 101.

Figure 6A:
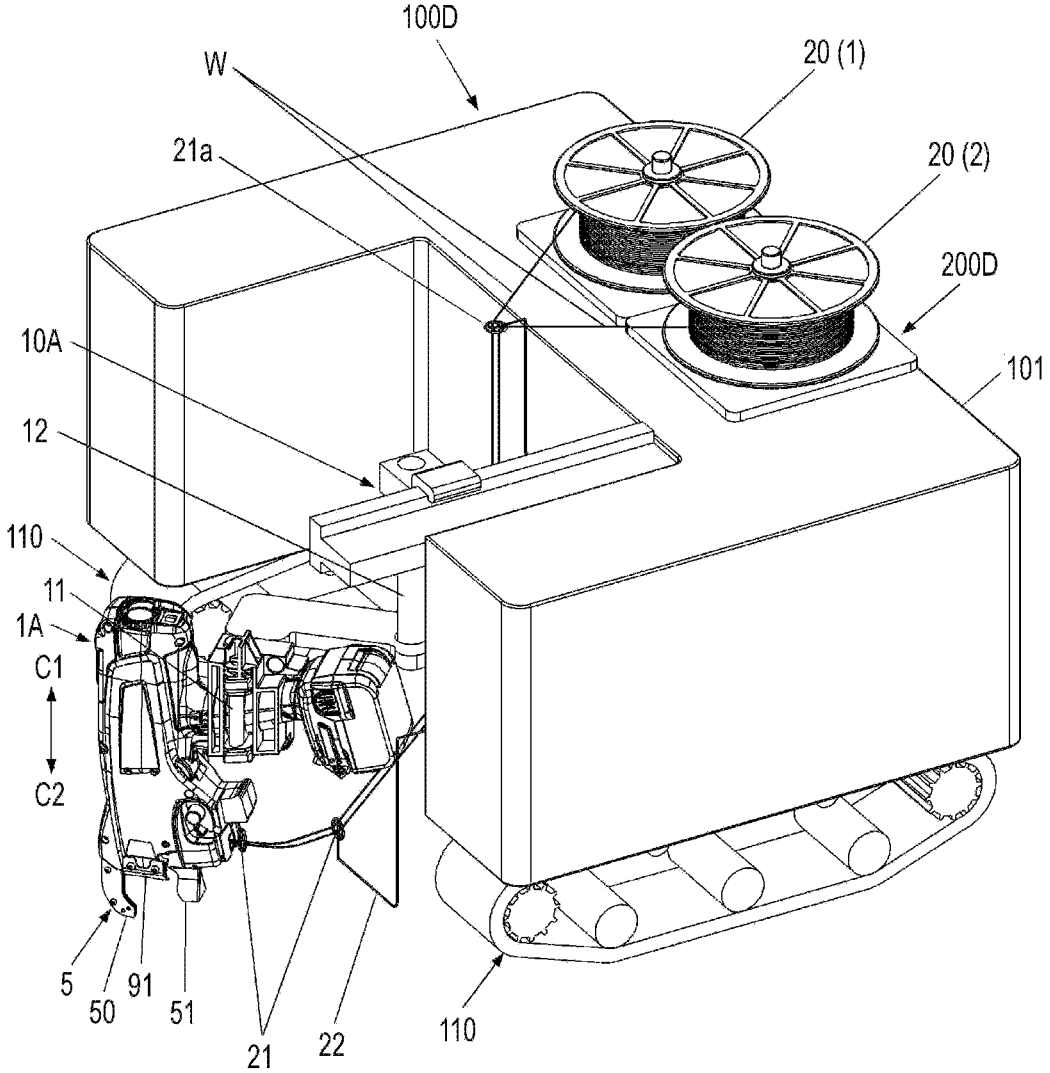
FIG. 6A is a perspective view showing an example of a binding device according to a fourth embodiment.
Figure 6B:
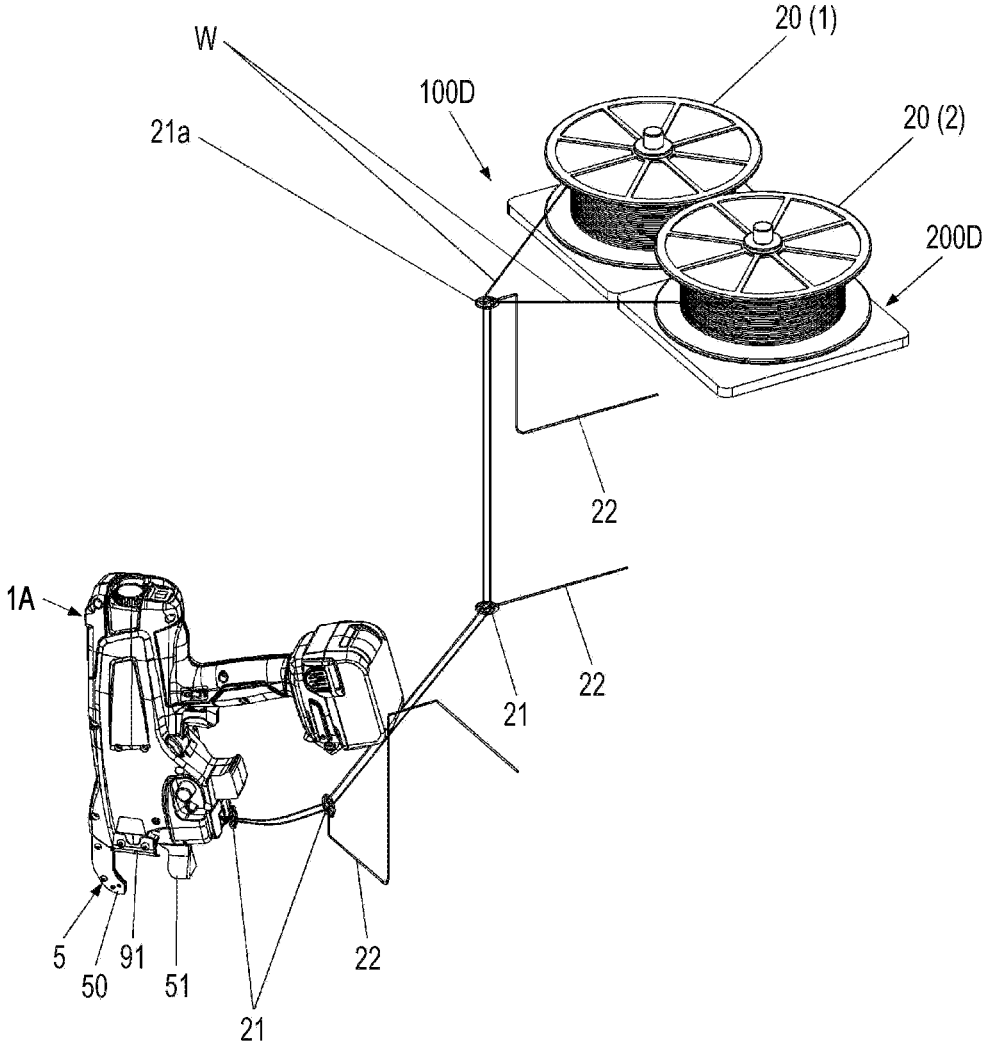
FIG. 6B is a perspective view showing an example of a wire feeding path.

FIG. 6A is a perspective view showing an example of a binding device according to a fourth embodiment, and FIG. 6B is a perspective view showing an example of a wire feeding path.

A binding device 100D of the fourth embodiment includes a reel accommodation part 200D that accommodates a plurality of reels 20, two reels 20 in the present example. The binding device 100D of the fourth embodiment has the same configuration as that of the binding device 100A of the first embodiment, except the reel accommodation part 200D.

In the reel accommodation part 200D, the two reels 20 accommodated in such an arrangement that the reels are aligned in the left-right direction intersecting the moving direction of the main body part 101 that is moved by the traveling part 110. In the present example, in the reel accommodation part 200D, the two reels 20 are provided at left and right positions symmetrical to each other with respect to an imaginary line (not shown) extending in the moving direction of the main body part 101 that is moved by the traveling part 110. Additionally, in the reel accommodation part 200D, the two reels 20 are each provided on an inner side of each of the pair of traveling parts 110 provided on both sides in the left-right direction intersecting the moving direction of the main body part 101. Further, in the reel accommodation part 200D, the two reels 20 are rotatably accommodated with axes of rotation being longitudinal orientations along the vertical direction.

Figure 7A:
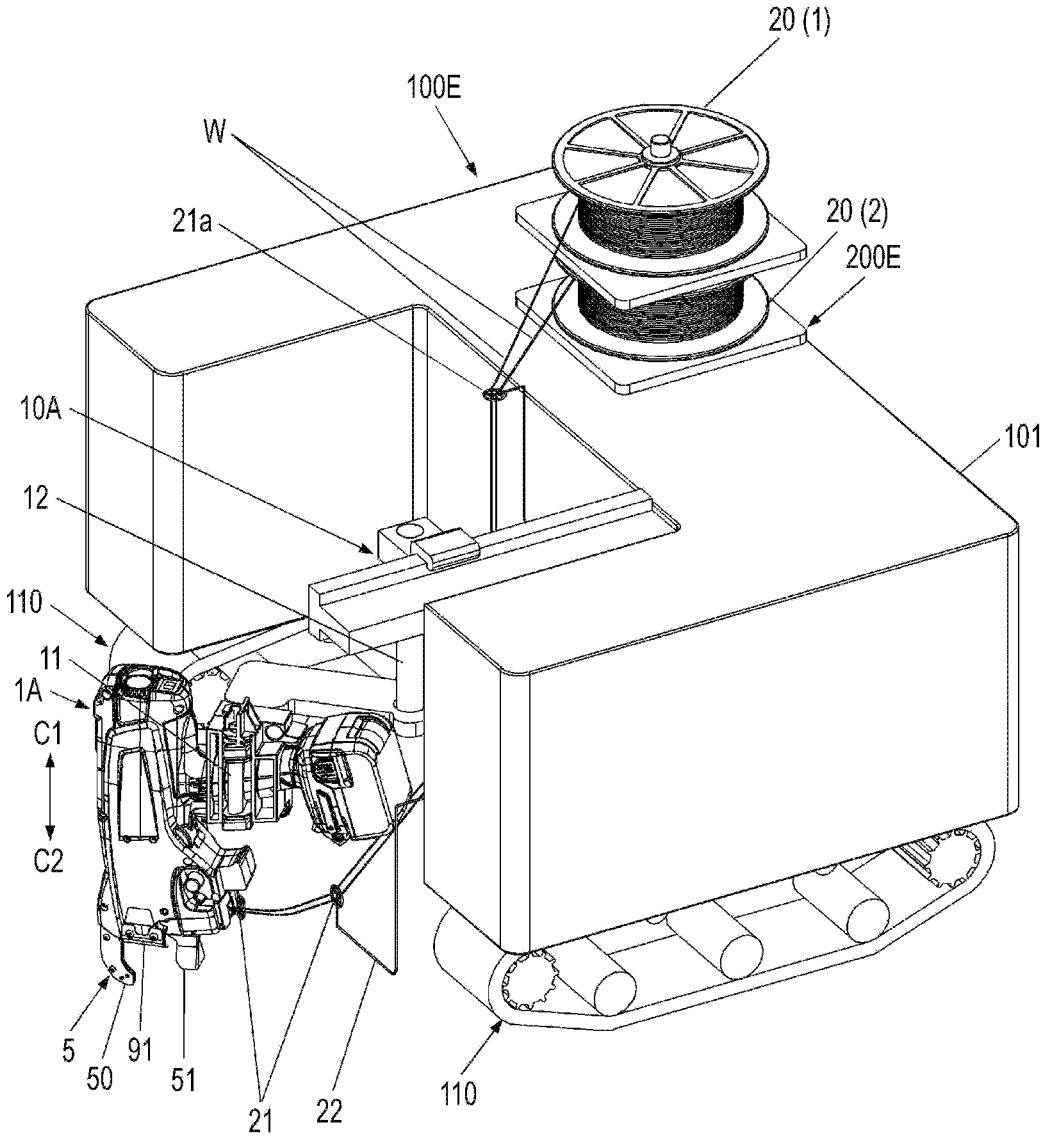
FIG. 7A is a perspective view showing an example of a binding device according to a fifth embodiment.
Figure 7B:
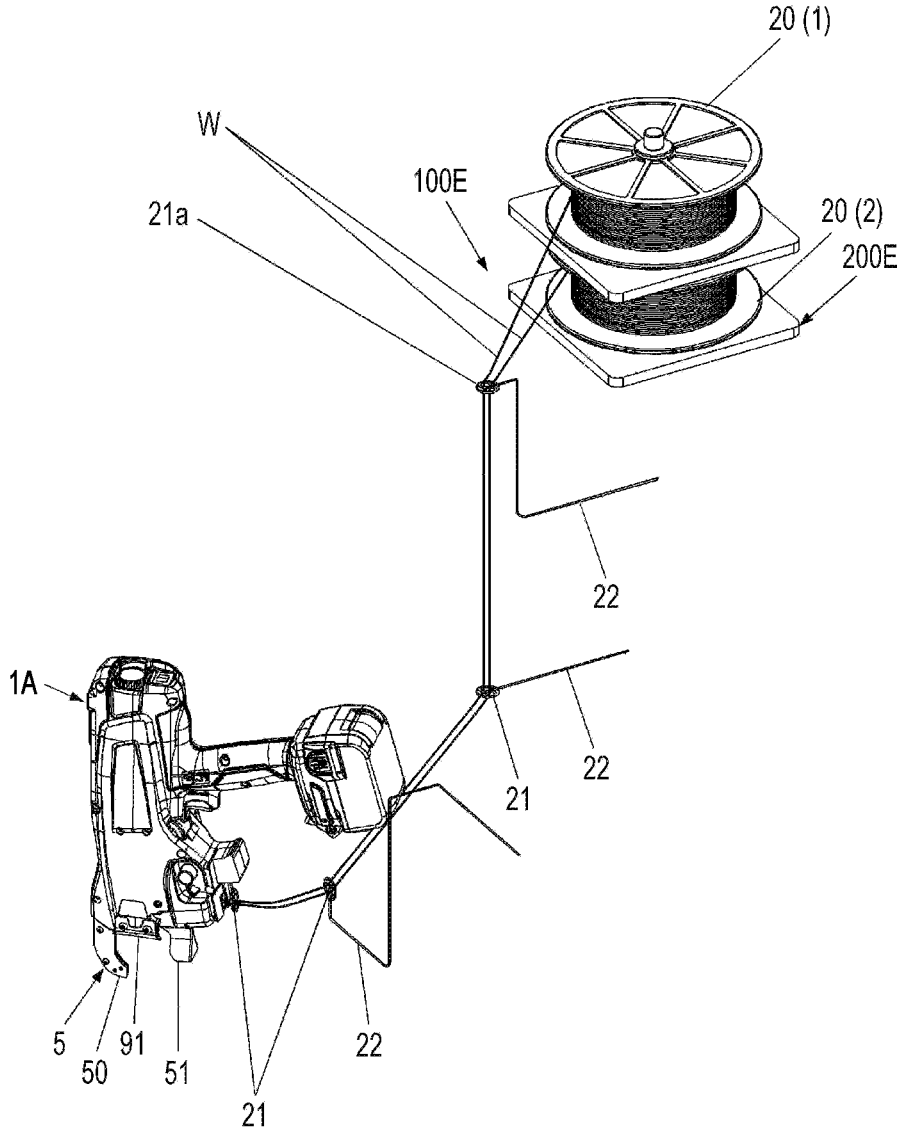
FIG. 7B is a perspective view showing an example of a wire feeding path.

FIG. 7A is a perspective view showing an example of a binding device according to a fifth embodiment, and FIG. 7B is a perspective view showing an example of a wire feeding path.

A binding device 100E of the fifth embodiment includes a reel accommodation part 200E that accommodates a plurality of reels 20, two reels 20 in the present example. The binding device 100E of the fifth embodiment has the same configuration as that of the binding device 100A of the first embodiment, except the reel accommodation part 200E.

In the reel accommodation part 200E, the two reels 20 are accommodated in such an arrangement that the reels are aligned in the vertical direction intersecting the moving direction of the main body part 101 that is moved by the traveling part 110. In the present example, in the reel accommodation part 200E, the two reels 20 are provided on an inner side of the pair of traveling parts 110 provided on both sides in the left-right direction intersecting the moving direction of the main body part 101. Further, in the reel accommodation part 200E, the two reels 20 are rotatably accommodated in such an arrangement that the reels are overlapped coaxially along the axial directions, with axes of rotation being longitudinal orientations along the vertical direction.

Configuration Example of Reinforcing Bar Binding Machine

Figure 8:
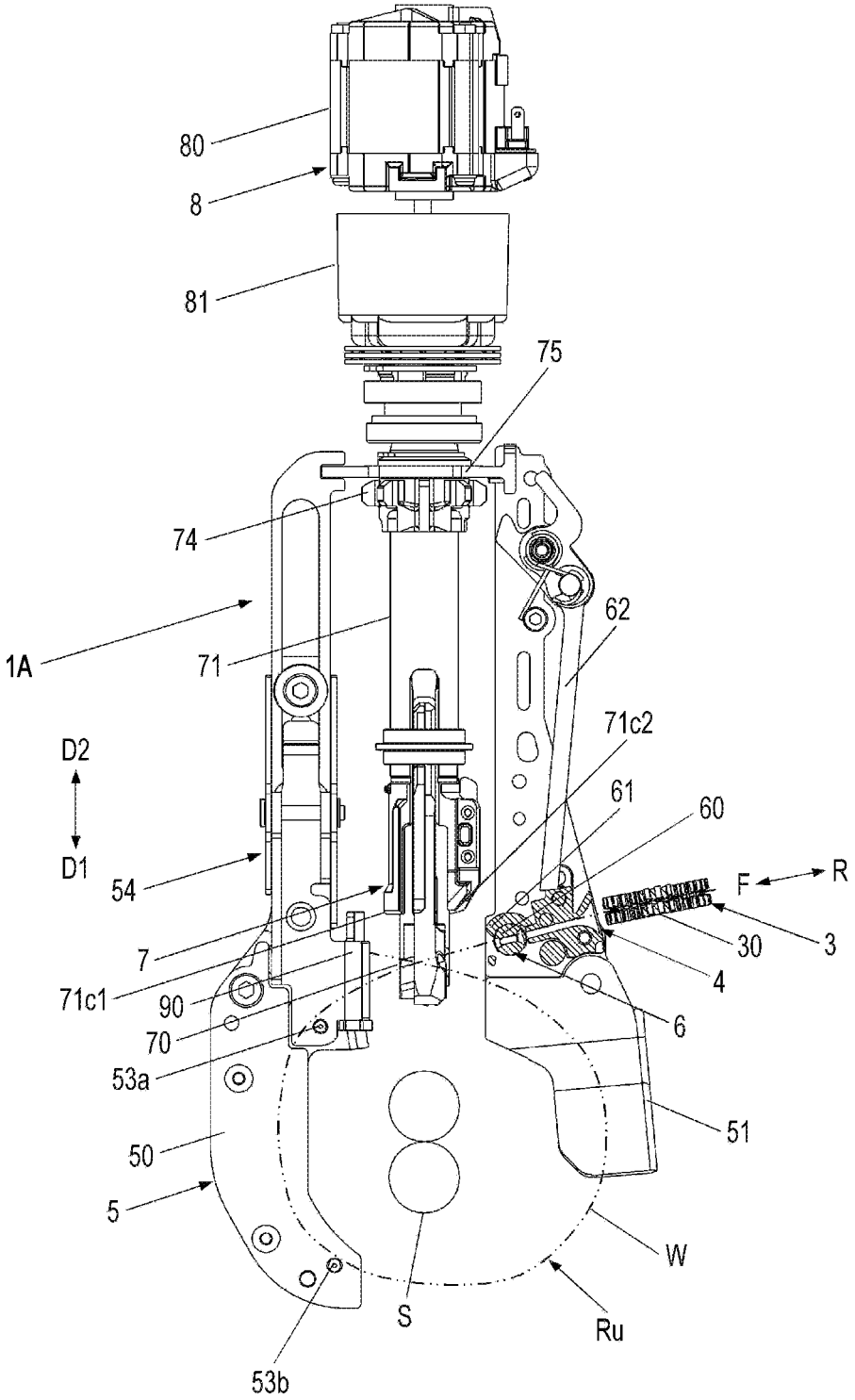
FIG. 8 is a side view of main parts showing an example of an internal configuration of a reinforcing bar binding machine according to the present embodiment.

FIG. 8 is a side view of main parts showing an example of an internal configuration of the reinforcing bar binding machine according to the present embodiment.

The reinforcing bar binding machine 1A is an example of the binding mechanism, and feeds a wire W in a forward direction denoted with an arrow F, winds the wire around two intersecting reinforcing bars S, which are an object to be bound, feeds the wire W wound around the reinforcing bars S in a reverse direction denoted with an arrow R, winds the wire on the reinforcing bars S, and twists the wire W, thereby binding the reinforcing bars S with the wire W. For the wire W, a wire made of a plastically deformable metal wire, a wire having a metal wire covered with a resin, or a twisted wire is used.

In order to implement the functions described above, the reinforcing bar binding machine 1A includes a wire feeding part 3 that feeds the wire W in the forward direction and the reverse direction, and a wire guide 4 that guides the wire W fed by the wire feeding part 3.

In addition, the reinforcing bar binding machine 1A includes a curl forming part 5 that forms a path along which the wire W fed by the wire feeding part 3 is to be wound around the reinforcing bars S, and a cutting part 6 that cuts the wire W wound on the reinforcing bars S. Further, the reinforcing bar binding machine 1A includes a binding part 7 that twists the wire W wound on the reinforcing bars S, and a drive part 8 that drives the binding part 7.

When the reinforcing bar binding machine 1A is used for the binding device 100A, 100B, 100C, 100D, 100E, and a binding device 100F to be described later, it is used in such a form that the curl forming part 5 faces downward. Hereinafter, in the reinforcing bar binding machine 1A used for the binding device 100A, 100B, 100C, 100D, 100E, 100F, a side on which the curl forming part 5 is provided is set as a lower side.

The wire feeding part 3 includes a pair of feeding gears 30 that sandwiches and feeds one or a plurality of wires W aligned in parallel. In the wire feeding part 3, the pair of feeding gears 30 is urged toward each other, and a rotating operation of a feeding motor (not shown) is transmitted to rotate the feeding gears 30. Thereby, the wire feeding part 3 feeds the wire W sandwiched between the pair of feeding gears 30 along an extension direction of the wire W. In a configuration where a plurality of, for example, two wires W are fed, the two wires W are fed aligned in parallel.

The wire guide 4 is provided at a predetermined position on each of an upstream side and a downstream side of the wire feeding part 3 with respect to a forward feeding direction of the wire W denoted with an arrow F. Note that, in FIG. 8, the wire guide 4 provided on the upstream side of the wire feeding part 3 is not shown.

The wire guide 4 is provided with an opening extending along the feeding direction of the wire W, and an opening area of the opening on the downstream side is configured to be smaller, as compared with the opening on the upstream side along the forward feeding direction of the wire W. For example, the wire guide 4 is configured to have a tapered opening whose opening area is largest on an introduction-side of the wire W, which is fed in the forward direction, and is gradually reduced from the introduction-side. Thereby, the wire guide 4 guides the wire W fed in the forward direction and passing through the wire guide 4 toward a space between the pair of feeding gears 30 and toward the cutting part 6.

In a configuration in which the reinforcing bar binding machine 1A binds the reinforcing bars S with two wires W, the wire guide 4 has a shape in which the opening on the downstream side along the forward feeding direction of the wires W regulates an orientation in a radial direction of the two wires W. Thereby, the wire guide 4 arranges the two wires W fed in the forward direction and passing through the wire guide 4 in parallel along a direction in which the pair of feeding gears 30 is aligned, and guides the two wires toward a space between the pair of feeding gears 30 and toward the cut part 6. Note that the path induction member 21 closest to the reinforcing bar binding machine 1A shown in FIG. 1A and the like guides the two wires W toward the wire guide 4.

The curl forming part 5 includes a curl guide 50 that curls the wire W fed by the wire feeding part 3, and an induction guide 51 that guides the wire W curled by the curl guide 50 toward the binding part 7.

In the reinforcing bar binding machine 1A, the feeding path of the wire W that is fed by the wire feeding part 3 is regulated by the curl forming part 5, so that a locus of the wire W becomes a loop Ru as shown with a broken line in FIG. 8 and the wire W is thus wound around the reinforcing bars S.

The curl forming part 5 has guide members 53*a* and 53*b* that guide the wire W fed in the forward direction and curl the wire W. The guide member 53*a* is provided on a side of the curl guide 50 on which the wire W fed by the wire feeding part 3 is introduced, and is arranged on a radially inner side of the loop Ru that is formed by the wire W fed by the wire feeding part 3. The guide member 53*b* is provided on a side of the curl guide 50 on which the wire W fed by the wire feeding part 3 is discharged, and is arranged on a radially outer side of the loop Ru that is formed by the wire W.

The curl forming part 5 includes a guide member moving mechanism 54 that retreats the guide member 53*a*. The guide member moving mechanism 54 retreats the guide member 53*a* in conjunction with an operation of the binding part 7 after the wire W is wound around the reinforcing bars S.

The cutting part 6 includes a fixed blade part 60, a movable blade part 61 that cuts the wire W by cooperating with the fixed blade part 60, and a transmission mechanism 62 that transmits an operation of the binding part 7 to the movable blade part 61. The cutting part 6 cuts the wire W by a rotating operation of the movable blade part 61 about the fixed blade part 60 as a fulcrum shaft. The transmission mechanism 62 transmits an operation of the binding part 7 to the movable blade part 61 via a transmission member 75 and rotates the movable blade part 61 in conjunction with the operation of the binding part 7, thereby cutting the wire W.

The binding part 7 includes a wire locking body 70 to which the wire W is locked, and a sleeve 71 for actuating the wire locking body 70. A detailed configuration of the binding part 7 will be described later. The drive part 8 includes a motor 80, and a decelerator 81 that performs deceleration and amplification of torque.

In a case where the reinforcing bar binding machine 1A has a form that an operator grips and uses with a hand, the reinforcing bar binding machine 1A includes a handle part 16 having a shape that the operator can grip with a hand, and a battery 17 is detachably mounted to the handle part 16. In the binding device 100A, the handle part 16 of the reinforcing bar binding machine 1A is mounted to a binding machine mounting part 11 of the binding machine moving part 10A. Note that the reinforcing bar binding machine 1A may have a configuration in which power is supplied from the binding device 100A, 100B, 100C, 100D, 100E, 100F.

The reinforcing bar binding machine 1A includes a feeding regulation part 90 against which a tip end of the wire W is butted, on the feeding path of the wire W that is fed in the forward direction by the wire feeding part 3 and passes through the curl forming part 5 to be wound around the reinforcing bars S.

In addition, the reinforcing bar binding machine 1A includes a butting portion 91 against which the reinforcing bars S inserted between the curl guide 50 and the induction guide 51 are butted, between the curl guide 50 and the induction guide 51 (refer to FIG. 1D).

When the reinforcing bar binding machine 1A mounted to the binding device 100A is moved to the binding position by the operation of the binding machine moving part 10A, the reinforcing bars S are inserted between the curl guide 50 and the induction guide 51, and the reinforcing bars S inserted between the curl guide 50 and the induction guide 51 are butted against the butting portion 91.

Configuration Example of Binding Part

Figure 9A:
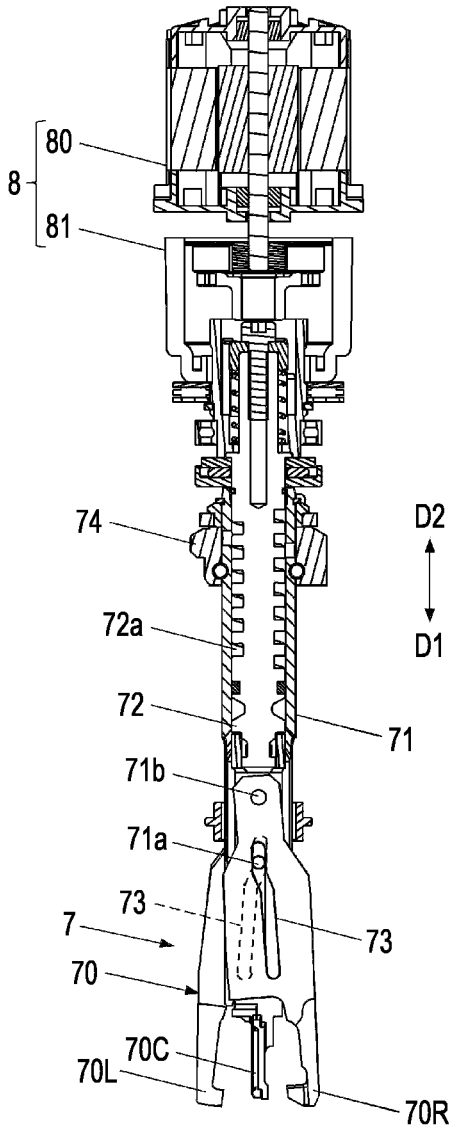
FIG. 9A is a sectional plan view showing an example of a binding part.
Figure 9B:
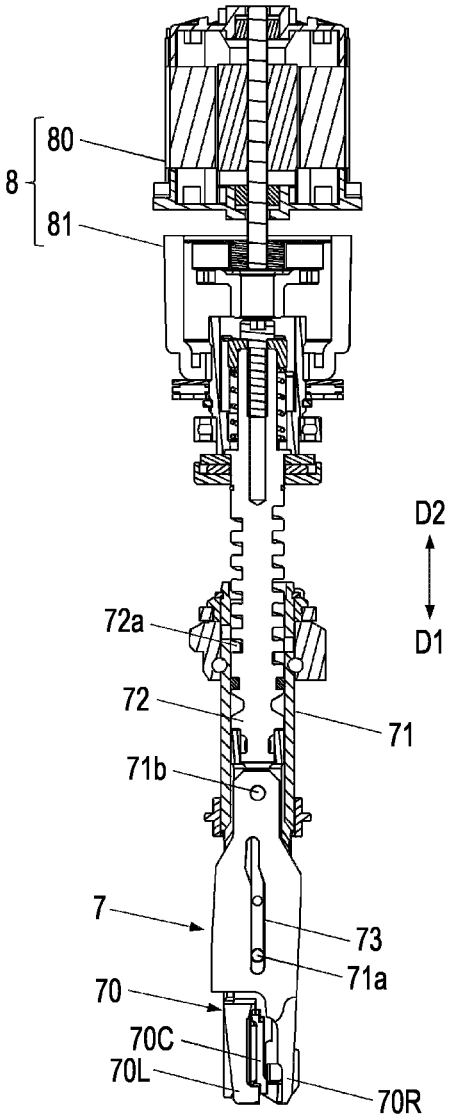
FIG. 9B is a sectional plan view showing the example of the binding part.

FIGS. 9A and 9B are sectional plan views showing an example of the binding part. Next, a configuration of the binding part will be described with reference to each drawing.

The binding part 7 includes a rotating shaft 72 that actuates the wire locking body 70 and the sleeve 71. The binding part 7 and the drive part 8 are configured such that the rotating shaft 72 and the motor 80 are connected via the decelerator 81 and the rotating shaft 72 is driven by the motor 80 via the decelerator 81.

The wire locking body 70 includes a center hook 70C connected to the rotating shaft 72, and a first side hook 70R and a second side hook 70L that open/close with respect to the center hook 70C.

The center hook 70C is connected to a tip end of the rotating shaft 72, which is one end portion along an axial direction of the rotating shaft 72, via a configuration that can rotate with respect to the rotating shaft 72 and move integrally with the rotating shaft 72 in the axial direction.

The wire locking body 70 opens/closes in directions in which the tip end-side of the first side hook 70R contacts/separates with respect to the center hook 70C by a rotating operation about a shaft 71*b* as a fulcrum. The wire locking body also opens/closes in directions in which the tip end side of the second side hook 70L contacts/separates with respect to the center hook 70C.

The sleeve 71 has a convex portion (not shown) protruding from an inner circumferential surface of a space in which the rotating shaft 72 is inserted, and the convex portion enters a groove portion of a feeding screw 72*a* formed along the axial direction on an outer circumference of the rotating shaft 72. When the rotating shaft 72 rotates, the sleeve 71 moves in the upper and lower direction, which is a direction along the axial direction of the rotating shaft 72, according to a rotation direction of the rotating shaft 72 by an action of the convex portion (not shown) and the feeding screw 72*a* of the rotating shaft 72. The sleeve 71 also rotates integrally with the rotating shaft 72.

The sleeve 71 has an opening/closing pin 71*a* that opens/closes the first side hook 70R and the second side hook 70L.

The opening/closing pin 71*a* is inserted into opening/closing guide holes 73 formed in the first side hook 70R and the second side hook 70L. The opening/closing guide hole 73 has a shape of extending along a moving direction of the sleeve 71 and converting a linear motion of the opening/closing pin 71*a* that moves in conjunction with the sleeve 71 into an opening/closing operation by rotation of the first side hook 70R and the second side hook 70L about the shaft 71*b* as a fulcrum.

The wire locking body 70 is configured such that, when the sleeve 71 is moved in an upward direction denoted with an arrow D2, the first side hook 70R and the second side hook 70L move away from the center hook 70C by the rotating operation about the shaft 71*b* as a fulcrum, due to a locus of the opening/closing pin 71*a* and the shape of the opening/closing guide holes 73.

Thereby, the first side hook 70R and the second side hook 70L are opened with respect to the center hook 70C, so that a feeding path through which the wire W passes is formed between the first side hook 70R and the center hook 70C and between the second side hook 70L and the center hook 70C.

In a state where the first side hook 70R and the second side hook 70L are opened with respect to the center hook 70C, the wire W that is fed by the wire feeding part 3 passes between the center hook 70C and the first side hook 70R. The wire W passing between the center hook 70C and the first side hook 70R is guided to the curl forming part 5. Then, the wire W curled by the curl forming part 5A and guided to the binding part 7 passes between the center hook 70C and the second side hook 70L.

The wire locking body 70 is configured such that, when the sleeve 71 is moved in a downward direction denoted with an arrow D1, the first side hook 70R and the second side hook 70L move toward the center hook 70C by the rotating operation about the shaft 71*b* as a fulcrum, due to the locus of the opening/closing pin 71*a* and the shape of the opening/closing guide holes 73. Thereby, the first side hook 70R and the second side hook 70L are closed with respect to the center hook 70C.

When the first side hook 70R is closed with respect to the center hook 70C, the wire W sandwiched between the first side hook 70R and the center hook 70C is locked in such an aspect that the wire can move between the first side hook 70R and the center hook 70C. In addition, when the second side hook 70L is closed with respect to the center hook 70C, the wire W sandwiched between the second side hook 70L and the center hook 70C is locked in such an aspect that the wire cannot come off between the second side hook 70L and the center hook 70C.

The sleeve 71 has a bending portion 71*c*1 that presses and bends a tip end side (one end portion) of the wire W in a predetermined direction to form the wire W into a predetermined shape, and a bending portion 71*c*2 that presses and bends a terminal end side (other end portion) of the wire W cut by the cutting part 6 in a predetermined direction to form the wire W into a predetermined shape.

The sleeve 71 is moved in the downward direction denoted with the arrow D1, so that the tip end side of the wire W locked by the center hook 70C and the second side hook 70L is pushed and bent toward the reinforcing bars S by the bending portion 71*c*1. In addition, the sleeve 71 is moved in the downward direction denoted with the arrow D1, so that the terminal end side of the wire W locked by the center hook 70C and the first side hook 70R and cut by the cutting part 6 is pushed and bent toward the reinforcing bars S by the bending portion 71*c*2.

The binding part 7 includes a rotation regulation part 74 that regulates rotations of the wire locking body 70 and the sleeve 71 that are rotated in conjunction with the rotating operation of the rotating shaft 72. In the binding unit 7, the rotation regulation part 74 regulates rotation of the sleeve 71 that is rotated in conjunction with rotation of the rotating shaft 72, according to a position of the sleeve 71 along an axial position of the rotating shaft 72, so that the sleeve 71 is moved in the direction of the arrow D1 and the direction of the arrow D2 by the rotating operation of the rotating shaft 72.

Thereby, the sleeve 71 moves in the direction of the arrow D1 without rotating, so that the first side hook 70R and the second side hook 70L are closed with respect to the center hook 70C, and the wire W is locked. In addition, the sleeve 71 moves in the direction of the arrow D2 without rotating, so that the first side hook 70R and the second side hook 70L are opened with respect to the center hook 70C, and the locking of the wire W is released.

The binding part 7 is configured such that when the rotation regulation on the sleeve 71 by the rotation regulation part 74 is released, the sleeve 71 is rotated in conjunction with the rotation of the rotating shaft 72.

Thereby, the first side hook 70R and second side hook 70L and the center hook 70C locking the wire W are rotated to twist the locked wire W.

Example of Operational Effects of Binding Device of Present Embodiment

The reinforcing bar binding machine 1A has the configuration of feeding the two wires W around the intersection of the reinforcing bars S, winding the two wires W fed around the reinforcing bars S on the reinforcing bars S by the reverse feeding, and twisting the wires W to bind the reinforcing bars S. For this reason, in the binding device 100A, 100B, 100C, 100D, 100E, the two wires W are fed from the reel accommodation part 200A, 200B, 200C, 200D, 200E to the reinforcing bar binding machine 1A.

In the binding device 100A, 100B, 100C, 100D, 100E, in the present example, the two reels 20 are accommodated in the reel accommodation part 200A, 200B, 200C, 200D, 200E according to the number of wires W that are used in the reinforcing bar binding machine 1A, and one wire W is wound on each reel 20. This suppresses entanglement of the two wires W within the reels 20, which occurs when the two wires W are wound on one reel 20. Therefore, in the configuration in which the main body part 101 is traveled by the traveling part 110, the two wires W are suppressed from being entangled within the reels 20 due to vibration during travel or the like.

In this way, by adopting the configuration in which one wire W is wound on one reel 20, there is no need to consider occurrence of a large curl difference between a plurality of wires, the management cost of manufacturing a reel on which a wire is wound can be reduced, and the yield can be improved.

In addition, since deformation of the wire W due to the winding of the two wires W on one reel 20 can be eliminated, management of the feeding path of the wire W from the reel 20, outside the reinforcing bar binding machine 1A to the reinforcing bar binding machine 1A is facilitated. Further, factors affecting a curl locus of the wire W when winding the wire W around the reinforcing bars S with the reinforcing bar binding machine 1A can be eliminated.

Therefore, it is possible to suppress occurrence of poor pull-out of the wire W from the reel 20 or poor feeding on the feeding path.

In the reel accommodation part 200A, the two reels 20 are provided at positions symmetrical with respect to the imaginary center line O1 that passes through the center in the left-right direction orthogonal to the moving direction of the main body part 101 denoted with the arrows A1 and A2 and extends along the moving direction of the main body part 101.

The reel 20 on which the wire W is wound is a relatively heavy member in the binding device 100A. In the binding device 100A, the reels 20 are provided at the positions symmetrical with respect to the imaginary center line O1, so that the weight unbalance in the left-right direction orthogonal to the moving direction of the main body part 101 can be suppressed. In addition, in the binding device 100A, when the wires W are used in the operation of binding the reinforcing bars S by the reinforcing bar binding machine 1A and the amounts of wires W wound on the reels 20 are thus reduced, the amounts of wires W wound on the two reels 20 are substantially the same. Thereby, even when the amounts of wires W wound on the reels 20 are reduced, the weight unbalance in the left-right direction orthogonal to the moving direction of the main body part 101 can be suppressed.

In the binding device 100A, the traveling part 110 is provided on each of both sides in the left-right direction intersecting the moving direction of the main body part 101. By suppressing the weight unbalance in the left-right direction of the main body part 101, occurrence of inclination of the main body part 101 and the like can be suppressed. In addition, in the reel accommodation part 200A, the two reels 20 are provided on the inner sides of the pair of traveling parts 110, respectively. Thereby, the two relatively heavy reels 20 in the state where the wires W are wound thereon can be collected near the center of the binding device 100A in the left-right direction.

Note that, in the binding device 100A, the reinforcing bar binding machine 1A is attached to the main body part 101 such that the rotating shaft 72 of the reinforcing bar binding machine 1A shown in FIGS. 9A and 9B is positioned on an extension of the imaginary center line O1 shown in FIG. 1C in a vertically extending orientation. Thereby, in the binding device 100A, the two reels 20 are provided at positions symmetrical with respect to a line (not shown) extending from the rotating shaft 72 of the reinforcing bar binding machine 1A.

The reinforcing bar binding machine 1A is a relatively heavy member in the binding device 100A. In the binding device 100A, the reinforcing bar binding machine 1A is provided so that the rotating shaft 72 is located on the extension of the imaginary center line O1. As a result, the weight unbalance in the left-right direction orthogonal to the moving direction of the main body part 101 can be suppressed.

In addition, in the binding device 100A, the two reels 20 are provided at positions symmetrical with respect to the rotating shaft 72 of the reinforcing bar binding machine 1A, and the two reels 20 are each provided on the inner side of each of the pair of traveling parts 110. Thereby, it is possible to collect a heavy object near the center of the binding device 100A in the left-right direction, and to suppress the weight unbalance in the left-right direction orthogonal to the moving direction of the main body part 101.

On the other hand, as shown in the top view of FIG. 1C and the front view of FIG. 1D, the feeding path of the wire W ranging from the reel accommodation part 200A to the reinforcing bar binding machine 1A deviates in one direction with respect to the imaginary center line O1, and the path induction member 21*a* closest to the reel accommodation part 200A is provided at a position deviating in one direction with respect to the imaginary center line O1.

For this reason, a path length L1 of the wire W from one reel 20(1) to the path induction member 21*a* is different from a path length L2 of the wire W from the other reel 20(2) to the path induction member 21*a*, and a difference occurs between a path length from one reel 20(1) to the reinforcing bar binding machine 1A and a path length from the other reel 20(2) to the reinforcing bar binding machine 1A.

In the operation of binding the reinforcing bars S with the two wires W, the wires W of substantially the same length are each pulled out from each of the two reels 20. For this reason, when there is a difference between the path length from one reel 20(1) to the reinforcing bar binding machine 1A and the path length from the other reel 20(2) to the reinforcing bar binding machine 1A, for example, the wire W pulled out from the reel 20(1) from which the path length is longer may be first exhausted. In this case, if a length of the wire W remaining on the other reel 20(2) is longer than a length of the wire W required for one binding of the reinforcing bars S, when both the reels 20 are replaced at the same time, the wire W is wasted because the other reel 20(2) is replaced even though an amount of the wire W required for binding of the reinforcing bars S still remains.

Therefore, the difference between the path length from one reel 20(1) to the reinforcing bar binding machine 1A and the path length from the other reel 20(2) to the reinforcing bar binding machine 1A is set to be shorter than the length of the wire W required for one binding of the reinforcing bars S.

Thereby, in the operation of binding the reinforcing bars S with the two wires W, for example, when the wire W pulled out from one reel 20(1) is first exhausted, the wire W remaining on the other reel 20(2) is shorter than the length of the wire W required for one binding of the reinforcing bars S, so that the waste of the wire W is suppressed even when both the reels 20 are replaced at the same time.

Further, the difference between the path length from one reel 20(1) to the reinforcing bar binding machine 1A and the path length from the other reel 20(2) to the reinforcing bar binding machine 1A may be set to be smaller than a circumferential length of the winding core portion (not shown) of the reel 20, i.e., D×3.14 where D is a diameter of the winding core portion (not shown) of the reel 20.

If the difference between the path length from one reel 20(1) to the reinforcing bar binding machine 1A and the path length from the other reel 20(2) to the reinforcing bar binding machine 1A is large, a difference in an amount of the wire W pulled out from each reel 20 to the reinforcing bar binding machine 1A increases, so that a difference in a remaining amount of the wire W wound on each reel 20 increases. When the difference in the remaining amount of the wire W wound on each reel 20 increases, a position in the radial direction of the reel 20 where the wire W is pulled out is different, and a difference in the mass of the reel 20 including the wire W increases, making it difficult to feed the two wires W in parallel. In addition, in the operations of feeding the wire W in the forward direction, curling the wire W in the curling part 5 and winding the wire around the reinforcing bar S in the reinforcing bar binding machine 1A, the curl locus of the wire W may not be stable.

In contrast, when the difference between the path length from one reel 20(1) to the reinforcing bar binding machine 1A and the path length from the other reel 20(2) to the reinforcing bar binding machine 1A is set to be shorter than the length of the wire W required for one binding of the reinforcing bars S, the difference between the path length from one reel 20(1) to the reinforcing bar binding machine 1A and the path length from the other reel 20(2) to the reinforcing bar binding machine 1A can be reduced. In addition, when the difference between the path length from one reel 20(1) to the reinforcing bar binding machine 1A and the path length from the other reel 20(2) to the reinforcing bar binding machine 1A is set to be shorter than the circumferential length of the winding core portion (not shown) of the reel 20, the difference between the path length from one reel 20(1) to the reinforcing bar binding machine 1A and the path length from the other reel 20(2) to the reinforcing bar binding machine 1A can be reduced.

The difference between the path length from one reel 20(1) to the reinforcing bar binding machine 1A and the path length from the other reel 20(2) to the reinforcing bar binding machine 1A can be reduced, so that the difference in the remaining amount of the wire W wound on each reel 20 is reduced, the position in the radial direction of the reel 20 where the wire W is pulled out becomes substantially the same, and the difference in the mass of the reel 20 including the wire W is reduced. This stabilizes the path of the wire W between the two wires W, and facilitates management of the feeding path of the wire W from the reel 20 outside the reinforcing bar binding machine 1A to the reinforcing bar binding machine 1A. Further, factors affecting a curl locus of the wire W when winding the wire W around the reinforcing bars S with the reinforcing bar binding machine 1A can be eliminated.

Also in the binding device 100B shown in FIGS. 4A and 4B, the reel accommodation part 200B includes the two reels 20(1) and 20(2) provided at the left and right positions symmetrical to each other with respect to the moving direction of the main body part 101 that is moved by the traveling part 110. Also in the binding device 100D shown in FIGS. 6A and 6B, the reel accommodation part 200D includes the two reels 20(1) and 20(2) provided at the left and right positions symmetrical to each other with respect to the moving direction of the main body part 101 that is moved by the traveling part 110. This makes it possible to suppress the weight unbalance in the left-right direction of the main body part 101, similar to the binding device 100A, regardless of the orientation of the rotating shaft of the reel 20.

In addition, in the binding device 100E shown in FIGS. 7A and 7B, the rotating shafts of the reel 20 are set in the vertical orientation, so the two reels 20(1) and 20(2) of the reel accommodation part 200E can be overlapped and arranged on or near the imaginary center line O1 shown in FIG. 1. This makes it possible to collect the heavy object near the center of the binding device 100E in the left-right direction and to suppress the weight unbalance in the left-right direction orthogonal to the moving direction of the main body part 101.

In each of the above-described binding devices 100A, 100B, 100C, 100D and 100E, the wire W is caused to pass through the annular path induction members 21(21*a*), so that the feeding path of the wire W ranging from the reel accommodation part 200A, 200B, 200C, 200D, 200E to the reinforcing bar binding machine 1A is formed. The path of the wire W includes a straight place and a place where the wire W is bent by the path induction member 21(21*a*).

In this way, if a place where the wire W is bent by the path induction member 21(21*a*) is on the feeding path of the wire W, a so-called bending curl is formed in which the wire W does not become straight but becomes a bent state.

For this reason, if there is a difference in an angle at which the wire W is bent by the path induction member 21(21*a*) and in a direction in which the wire W is bent between the feeding paths of the two wires W, it is difficult to feed the two wires W in parallel due to the difference in bending angle or bending direction of the two wires W, which is caused due to the curl formed when the wires pass through the path induction member 21(21*a*). In addition, in the operations of feeding the wire W in the forward direction, curling the wire W in the curling part 5 and winding the wire around the reinforcing bar S in the reinforcing bar binding machine 1A, the curl locus of the wire W may not be stable.

In contrast, in the binding device 100C shown in FIGS. 5A and 5B, the reels 20(1) and 20(2) can be arranged at positions symmetrical with respect to an imaginary line (not shown) extending from the path induction member 21*a* closest to the reel accommodation part 200C. Thereby, the differences in the angle at which the wires W are bent by the path induction member 21*a* and in the direction in which the wires W are bent can be reduced between the wire W pulled out from one reel 20(1) and passing through the path induction member 21*a* and the wire W pulled out from the other reel 20(2) and passing through path induction member 21*a*. Therefore, the path of the wire W is stabilized between the two wires W, and management of the feeding path of the wire W from the reel 20 outside the reinforcing bar binding machine 1A to the reinforcing bar binding machine 1A is facilitated. Further, factors affecting a curl locus of the wire W when winding the wire W around the reinforcing bars S with the reinforcing bar binding machine 1A can be eliminated.

Further, in the binding device 100C, the difference between the path length of the wire W from one reel 20(1) to the path induction member 21*a* and the path length of the wire W from the other reel 20(2) to the path induction member 21*a* can be reduced, and the difference between the path length from one reel 20(1) to the reinforcing bar binding machine 1A and the path length from the other reel 20(2) to the reinforcing bar binding machine 1A can be reduced.

Configuration Example of Binding Device of Another Embodiment

Figure 10A:
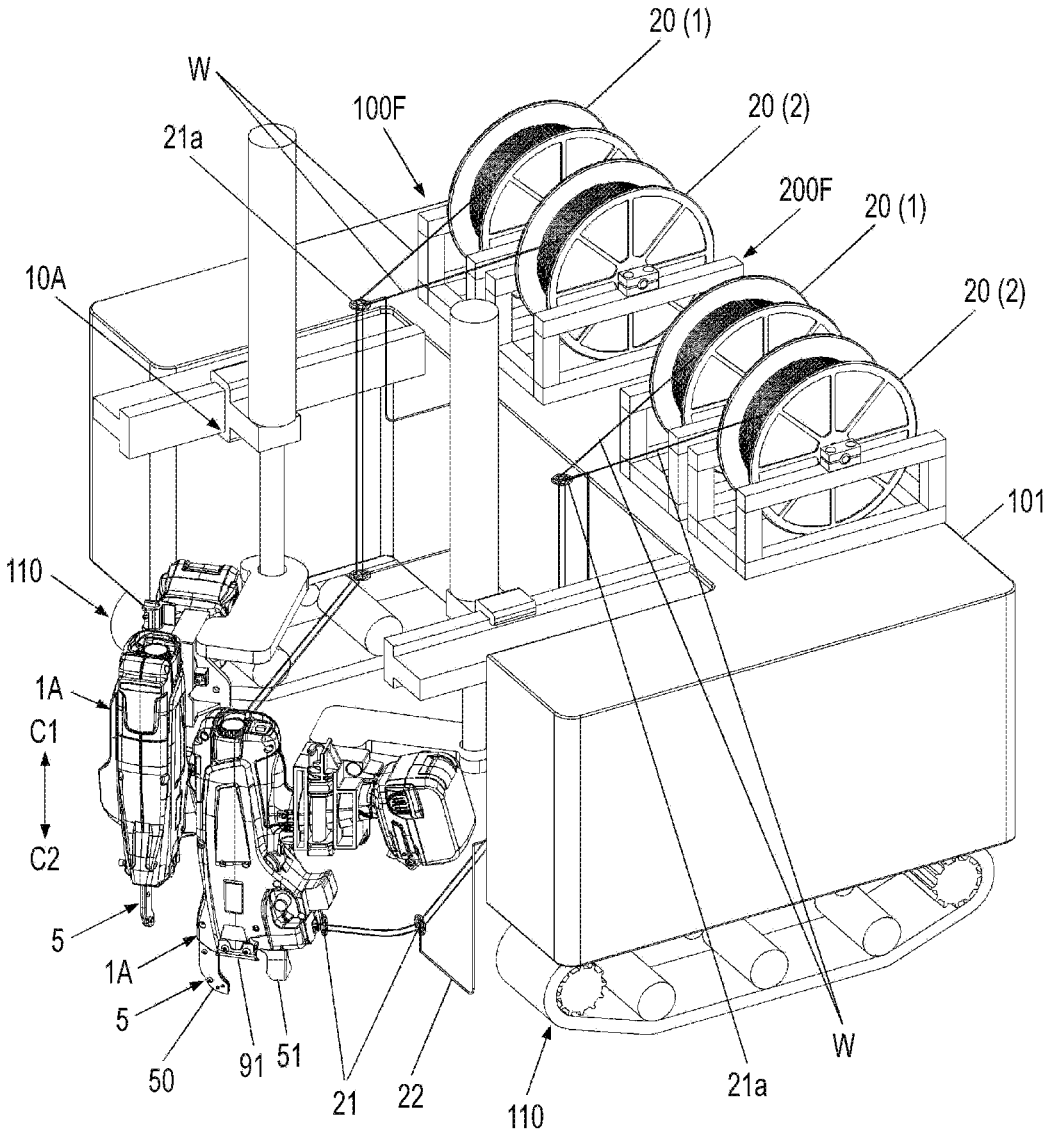
FIG. 10A is a perspective view showing an example of a binding device according to another embodiment.
Figure 10B:
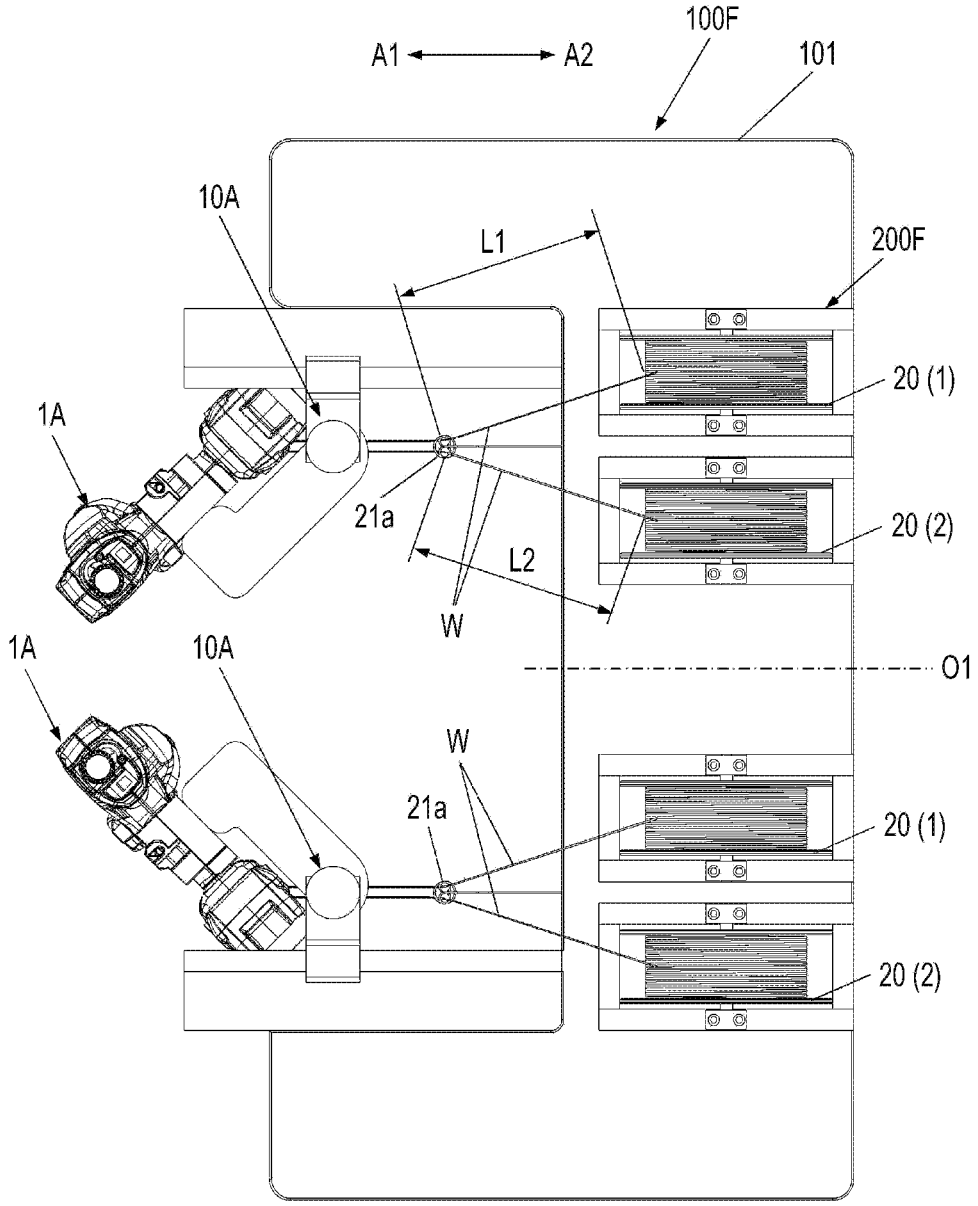
FIG. 10B is a top view showing the example of the binding device according to another embodiment.
Figure 10C:
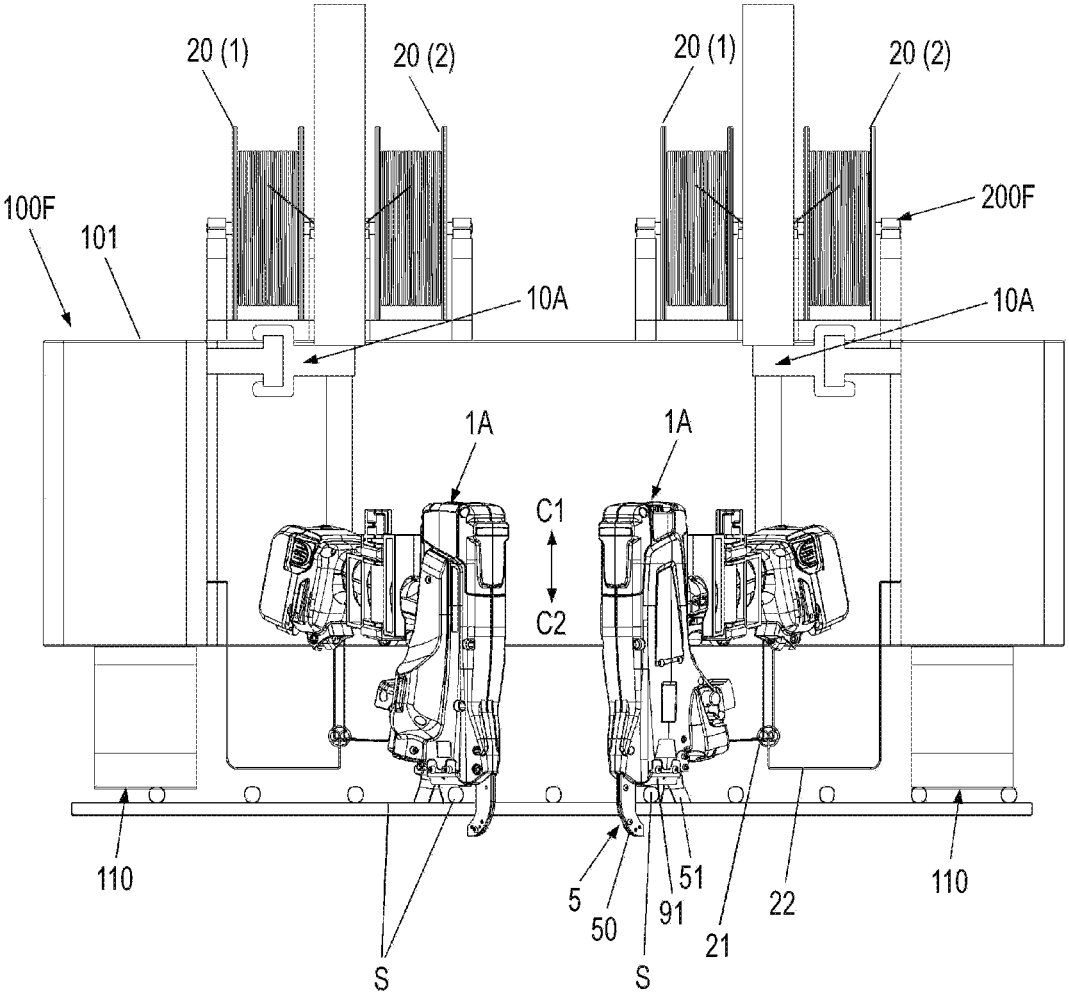
FIG. 10C is a front view showing the example of the binding device according to another embodiment.

FIG. 10A is a perspective view showing an example of a binding device according to another embodiment, FIG. 10B is a top view showing the example of the binding device according to another embodiment, and FIG. 10C is a front view showing the example of the binding device according to another embodiment.

A binding device 100F of another embodiment includes, on the main body part 101, a plurality of reinforcing bar binding machines 1A that bind intersections of reinforcing bars S arranged in a grid form with wires W, and a plurality of binding machine moving parts 10A that move the respective reinforcing bar binding machines 1A between the binding position and the retreat position in a substantially vertical direction intersecting an arrangement surface of the reinforcing bars S.

In addition, the binding device 100F includes, on the main body part 101, a reel accommodation part 200F in which the reels 20 on which the wires W that are used in the respective reinforcing bar binding machines 1A are wound are accommodated.

In the binding device 100F, the reel accommodation part 200F is provided on an upper surface of the main body part 101. The reel accommodation part 200F accommodates two reels 20 on each of which one wire W is wound to be pulled out for one reinforcing bar binding machine 1A that winds and binds the two wires W around the reinforcing bar S, and therefore, accommodates the four reels 20 for two reinforcing bar binding machines 1A.

In the reel accommodation part 200F, the two reels 20 corresponding to one reinforcing bar binding machine 1A are accommodated in such an arrangement that the reels are aligned in the left-right direction intersecting the moving direction (going straight) (indicated by arrows A1 and A2) of the main body part 101 that is moved by the traveling part 110. In addition, in the reel accommodation part 200F, the reels 20 corresponding to one reinforcing bar binding machine 1A are provided two by two at left and right positions symmetrical to each other with respect to the moving direction of the main body part 101 that is moved by the traveling part 110. Specifically, the reels 20 are provided two by two at positions symmetrical with respect to an imaginary center line O1 that passes through a center in the left-right direction of the main body part 101 orthogonal to the moving direction of the main body part 101 and extends along the moving direction of the main body part 101. Additionally, in the reel accommodation part 200F, the reels 20 are provided two by two on an inner side of each of the pair of traveling parts 110 provided on both sides in the left-right direction intersecting the moving direction of the main body part 101. Further, in the reel accommodation part 200F, the reels 20 are rotatably accommodated two by two in such an arrangement that the two reels are aligned coaxially along the axial directions, with axes of rotation being transverse orientations to the vertical direction.

Note that, in the reel accommodation part 200F, the arrangement of the reels 20 is not limited to these examples, and for example, as shown in FIG. 4, the reels 20 may be rotatably accommodated and arranged two by two in such an orientation that the axial directions thereof intersect each other, with axes of rotation being transverse orientations to the vertical direction. In addition, as shown in FIG. 5A, the reels 20 may be rotatably accommodated and arranged two by two in such an arrangement that the two reels are aligned coaxially along the axial directions, with axes of rotation being transverse orientations to the vertical direction and inclined orientations with respect to the moving direction of the main body part 101. Further, as shown in FIG. 6A, the reels 20 may be aligned and accommodated in the left-right direction with respect to the moving direction of the main body part 101, with axes of rotation being longitudinal orientations along the vertical direction. Further, as shown in FIG. 7A, the reels 20 may be vertically overlapped and accommodated two by two, with axes of rotation being longitudinal orientations along the vertical direction. Thereby, the binding device 100F obtains the operational effects similar to those of the binding devices 100A, 100B, 100C, 100D, and 100E.

What is claimed is:

1. A binding device configured to bind an intersection of reinforcing bars arranged in a grid shape with a plurality of wires, the binding device comprising:

a main body part; and a traveling part configured to travel the main body part along an arrangement surface of the reinforcing bars, wherein the main body part includes:

one or more binding mechanisms including a pair of feeding gears configured to sandwich and feed the plurality of wires around the reinforcing bars, a hook configured to twist and bind the plurality of wires fed around the reinforcing bars, and a first motor configured to drive the hook, a binding mechanism moving part including a binding machine bracket to which the binding mechanism is mounted, an actuator configured to move the binding machine bracket, and a second motor configured to drive the actuator, the binding mechanism moving part configured to move the binding mechanism between a binding position where binding of the reinforcing bars is performed and a retreat position away from the reinforcing bars, a reel holder configured to accommodate a plurality of reels on each of which one wire is wound in an arrangement that the reels are aligned in a left-right direction or an upper and lower direction, when the left-right direction is a direction intersecting a moving direction of the main body part and being along the arrangement surface, and the upper and lower direction is a vertical direction with respect to the arrangement surface, and a path induction member configured to form a feeding path of wires pulled out from the plurality of reels accommodated in the reel holder between the binding mechanism and the reel holder, and which is attached to the main body part by a support member and provided at the feeding path and which is configured to collect each of the wires pulled out from the plurality of reels in the reel holder and to guide the collected wires to one of the one or more binding mechanisms.

2. The binding device according to claim 1, wherein the reel holder is configured to accommodate the plurality of reels in an arrangement that the reels are aligned right and left with respect to a moving direction of the main body part that is moved by the traveling part.

3. The binding device according to claim 1, wherein the reel holder is configured to accommodate the plurality of reels in an arrangement that the reels are left-right symmetrical to each other with respect to a moving direction of the main body part that is moved by the traveling part.

4. The binding device according to claim 1, wherein the reel holder is configured to accommodate the plurality of reels in an arrangement that the reels are overlapped and rotation axes of the reels are along a vertical direction.

5. The binding device according to claim 4, wherein, in the reel holder, the plurality of reels are accommodated in an arrangement that the reels are vertically overlapped.

6. The binding device according to claim 1, wherein the binding mechanism includes a binding part configured to twist the wires by a rotating operation, and wherein the reel holder is configured to accommodate the plurality of reels in an arrangement that the reels are symmetrical to each other with respect to an imaginary line passing through a rotation axis of a rotating operation of the binding part.

7. The binding device according to claim 6, wherein, in the reel holder, the plurality of reels are accommodated in an arrangement that the reels are left-right symmetrical to each other with respect to the imaginary line.

8. The binding device according to claim 6, wherein an imaginary center line, extending in a traveling direction of the main body part by the traveling part, of the main body part in a left-right direction of the main body part crosses the imaginary line.

9. The binding device according to claim 1, wherein the reel holder is configured to accommodate the plurality of reels in an arrangement that the reels are symmetrical to each other with respect to an imaginary line extending from a path induction member closest to the reel holder among a plurality of path induction members.

10. The binding device according to claim 1, wherein the reel holder is configured that a difference between a path length of the feeding path of wire from one reel to the binding mechanism and a path length of the feeding path of wire from another reel to the binding mechanism is set shorter than a length of the wire required for the binding mechanism to perform one binding of the reinforcing bar.

11. The binding device according to claim 1, wherein the reel holder is configured that a difference between a path length of the feeding path of wire from one reel to the binding mechanism and a path length of the feeding path of wire from another reel to the binding mechanism is set shorter than a circumferential length of a core winding portion on which the wire of the reel is wound.

12. The binding device according to claim 1, wherein an imaginary center line, extending in a traveling direction of the main body part by the traveling part, of the main body part in a left-right direction of the main body part does not cross the path induction member.

13. The binding device according to claim 1, wherein the binding mechanism includes a binding part configured to twist the wires by a rotating operation, and wherein the reel holder is configured to accommodate the plurality of reels in an arrangement that the reels are symmetrical to each other with respect to an imaginary line passing through a rotation shaft of the binding part.

14. The binding device according to claim 1, wherein the path induction member has an annular shape.

* * * * *